US008218786B2

(12) United States Patent
Koga et al.

(10) Patent No.: US 8,218,786 B2
(45) Date of Patent: Jul. 10, 2012

(54) ACOUSTIC SIGNAL PROCESSING APPARATUS, ACOUSTIC SIGNAL PROCESSING METHOD AND COMPUTER READABLE MEDIUM

(75) Inventors: Toshiyuki Koga, Kawasaki (JP); Kaoru Suzuki, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1327 days.

(21) Appl. No.: 11/902,512

(22) Filed: Sep. 21, 2007

(65) Prior Publication Data

US 2008/0089531 A1 Apr. 17, 2008

(30) Foreign Application Priority Data

Sep. 25, 2006 (JP) ..... 2006-259343

(51) Int. Cl.
*H04R 3/00* (2006.01)

(52) U.S. Cl. ..... 381/92; 381/98; 381/122

(58) Field of Classification Search ..... 381/92, 381/98, 122

See application file for complete search history.

(56) References Cited

U.S. PATENT DOCUMENTS

2006/0204019 A1 9/2006 Suzuki et al.
2006/0215854 A1 9/2006 Suzuki et al.

FOREIGN PATENT DOCUMENTS

JP 2003-337164 11/2003

OTHER PUBLICATIONS

Shimoyama et al "Multiple acoustic source localization using ambiguous phase differences under reverberative conditions", Acoust. Sci. & Tech., Jun. 18, 2004, pp. 446-456.*

Nakadai et al., "Real-Time Active Tracking by Hierarchical Integration of Audition and Vision," JSAI Technical Report, SIG-Challenge-0317-6, pp. 35-42. (Abstract Attached).

Asano, Japanese Journal of the Society of Instrument and Control Engineers, vol. 43, No. 4, (2004), pp. 325-330.

* cited by examiner

*Primary Examiner* — Phat X Cao

(74) *Attorney, Agent, or Firm* — Nixon & Vanderhye, P.C.

(57) ABSTRACT

Hough transform is performed on the point groups forming two dimensional data to generate a plurality of loci respectively corresponding to each of the point groups in a Hough voting space. When adding a voting value to a position in the Hough voting space through which the plurality of loci passes, addition is performed by varying the voting value based on a level difference between first and second signals respectively indicated by the two pieces of frequency decomposition information.

12 Claims, 30 Drawing Sheets

(a)

(b)

(b)

WINDOWING FUNCTION $w=\cos((2\pi \times n) \div (N-1))$

Hamming [n]=0.54−(0.46×w)

Hamming [n]=0.5−(0.5×w)

WHERE "n" IS THE DATA NUMBER IN FRAME DATA{n:0≧n≧N-1}

124

```
PHASE DIFFERENCE
    △Ph(fk)=Ph2(fk)−Ph1(fk);
    while(1){
        if(△Ph(fk)≦−π){△Ph(fk)=△Pf(fk)+2π;continue;}
        break;
    }
    while(1){
        if(△Ph(fk)>π){△Ph(fk)=△Pf(fk)−2π;continue;}
        break;
    }
```

WHERE Ph1(fk) IS A PHASE VALUE IN A FREQUENCY COMPONENT fk OF THE MICROPHONE 1a, Ph2(fk) IS A PHASE VALUE IN A FREQUENCY COMPONENT fk OF THE MICROPHONE 1b, AND THE RANGE OF Ph(fk) IS GIVEN BY $\{Ph(fk): -\pi < \Delta Ph(fk) \leqq \pi\}$

FIG. 6

COORDINATE VALUES $x(fk)=\triangle Ph(fk)$ $y(fk)=k$

FIG. 7

POWER FUNCTIONS $G(P(fk))=V+1 \quad : V>0$ $G(P(fk))=1 \quad : V>0$

WHERE $V=\log_{10}(P(fk))+\alpha$ $P(fk)=(Po2(fk)+Po1(fk))/2$

FIG.13

SONIC VELOCITY Vs=331.4+0.604t[m/sec]
WHERE "t" IS TEMPERATURE(°C)

$\Delta Tmax = L \div Vs$ [sec]

$\Delta T = (\Delta Ph(\theta, k)/2\pi) \times (1/fk)$

WHERE, $\Delta Ph(\theta, k) = k \cdot \tan(-\theta)$

ACOUSTIC SIGNAL PROCESSING APPARATUS, ACOUSTIC SIGNAL PROCESSING METHOD AND COMPUTER READABLE MEDIUM

CROSS REFERENCE TO RELATED APPLICATIONS

This application is based upon and claims the benefit of priority from the prior Japanese Patent Applications No. 2006-259343, filed on Sep. 25, 2006; the entire contents of which are incorporated herein by reference.

BACKGROUND OF THE INVENTION

1. Field of the Invention

The present invention relates to an apparatus for processing acoustic signals, and in particular, to an apparatus capable of estimating the number of sources of sound waves propagating through a medium, the directions of the sources, and the frequency components of the sound waves arriving from the sources.

2. Related Art

Over recent years, in the field of robot audition research, methods have been proposed for estimating a number of a plurality of object source sounds in a noise environment and directions thereof (sound source specification), and separating and extracting the respective source sounds (sound source separation).

For instance, according to Asano, Futoshi, "Separating Sound", Journal of the Society of Instrument and Control Engineers, Vol. 43, No. 4, 325-330, April 2004 described below, a method is presented in which, in a given environment with background noise, "N" number of source sounds are observed using "M" number of microphones, a spatial correlation matrix is generated from data obtained by performing fast Fourier transform (FFT) processing on the respective microphone outputs, and obtaining major eigenvalues with large values by performing eigenvalue decomposition on the matrix in order to estimate "N" number of sound sources in the form of the number of the major eigenvalues. This method is based on the characteristics that directional signals such as a source sound are mapped on major eigenvalues while non-directional background noise is mapped on all eigenvalues. Eigenvectors corresponding to major eigenvalues become basis vectors of a signal partial space spread by signals from the sound sources, and the eigenvectors corresponding to the remaining eigenvalues become basis vectors of a noise partial space spread by background noise signals. By applying the MUSIC method using the basis vectors in the noise partial space, position vectors of the respective sound sources may be retrieved, and sound from the sound sources may be extracted by a beam former provided with directivities in the retrieved directions. However, when the number of sound sources "N" is equivalent to the number of microphones "M", a noise partial space cannot be defined. In addition, when the number of sound sources "N" exceeds the number of microphones "M", undetectable sound sources will exist. Accordingly, the number of sound sources which may be estimated will never equal or exceed the number of microphones "M". While this method does not particularly impose any significant limitations regarding sound sources and is also mathematically aesthetic, the method does impose a limitation in that addressing a large number of sound sources will require a greater number of microphones.

Additionally, for instance, according to Nakadai, Kazuhiro, et al., "Real-Time Active Human Tracking by Hierarchical Integration of Audition and Vision", The Japanese Society for Artificial Intelligence AI Challenge Study Group, SIG-Challenge-0113-5, 35-42, June 2001 described below, a method is proposed in which sound source specification and sound source separation are performed using a single pair of microphones. This method focuses on a harmonic structure (a frequency structure made up of a basic frequency and harmonics thereof) that is unique to sound produced through a tube (articulator) such as a human voice. By detecting harmonic structures with different basic frequencies from data obtained by Fourier-transforming acoustic signals captured by microphones, the method deems the number of detected harmonic structures to be the number of speakers, and estimates the directions of the speakers with belief factors using an interaural phase difference (IPD) and interaural intensity difference (IID) of each harmonic structure to estimate each source sound from the harmonic structures themselves. By detecting a plurality of harmonic structures from Fourier-transformed data, this method is capable of processing a greater number of sound sources than microphones. However, since a fundamental portion of the estimation of the number and directions of sound sources and source sounds is based on harmonic structures, the method is only capable of handling sound sources that have harmonic structures such as a human voice, and is unable to sufficiently respond to various sounds.

As described above, conventional techniques are faced with warring problems in that (1) if no limitations are imposed on sound sources, the number of sound sources may not equal or exceed the number of microphones, and (2) when arranging the number of sound sources to equal or exceed the number of microphones, limitations such as assumption of a harmonic structure must be imposed on sound sources. As a result, no methods have been established which is capable of handling a number of sound sources that exceeds the number of microphones without limiting sound sources.

SUMMARY OF THE INVENTION

According to an aspect of the present invention, there is provided with an acoustic signal processing apparatus comprising:

an acoustic signal inputting unit configured to input a plurality of acoustic signals obtained by a plurality of microphones arranged at different positions;

a frequency decomposing unit configured to respectively decompose each acoustic signal into a plurality of frequency components, and for each frequency component, generate frequency decomposition information for which a signal level and a phase have been associated;

a phase difference computing unit configured to compute a phase difference between two predetermined pieces of the frequency decomposition information, for each corresponding frequency component;

a two-dimensional data converting unit configured to convert into two dimensional data made up of point groups arranged on a two-dimensional coordinate system having a frequency component function as a first axis and a phase difference function as a second axis;

a voting unit configured to perform Hough transform on the point groups, generate a plurality of loci respectively corresponding to each of the point groups in a Hough voting space, and when adding a voting value to a position in the Hough voting space through which the plurality of loci passes, perform addition by varying the voting value based on a level difference between first and second signal levels respectively indicated by the two pieces of frequency decomposition information; and a shape detecting unit configured to retrieve a position where the voting value becomes maximum to detect, from the two-dimensional data, a shape which corresponds to the retrieved position, which indicates a proportional relationship between the frequency component and the phase difference, and which is used to estimate a sound source direction of each of the acoustic signals.

According to an aspect of the present invention, there is provided with an acoustic signal processing method comprising:

inputting a plurality of acoustic signals obtained by a plurality of microphones arranged at different positions;

decomposing each acoustic signal into a plurality of frequency components, and for each frequency component, generating frequency decomposition information for which a signal level and a phase have been associated, for each of the acoustic signals;

computing a phase difference between two predetermined pieces of the frequency decomposition information, for each corresponding frequency component;

convert into two dimensional data made up of point groups arranged on a two-dimensional coordinate system having a frequency component function as a first axis and a phase difference function as a second axis;

performing Hough transform on the point groups, generating a plurality of loci respectively corresponding to each of the point groups in a Hough voting space, and when adding a voting value to a position in the Hough voting space through which the plurality of loci passes, performing addition by varying the voting value based on a level difference between first and second signal levels respectively indicated by the two pieces of frequency decomposition information; and retrieving a position where the voting value becomes maximum to detect, from the two-dimensional data, a shape which corresponds to the retrieved position, which indicates a proportional relationship between the frequency component and the phase difference, and which is used to estimate a sound source direction of each of the acoustic signals.

According to an aspect of the present invention, there is provided with a computer readable medium storing an acoustic signal processing program for causing a computer to execute instructions to perform steps of:

inputting a plurality of acoustic signals obtained by a plurality of microphones arranged at different positions;

decomposing each acoustic signal into a plurality of frequency components, and for each frequency component, generating frequency decomposition information for which a signal level and a phase have been associated, for each of the acoustic signals;

compute a phase difference between two predetermined pieces of the frequency decomposition information, for each corresponding frequency component;

convert into two dimensional data made up of point groups arranged on a two-dimensional coordinate system having a frequency component function as a first axis and a phase difference function as a second axis;

performing Hough transform on the point groups, generating a plurality of loci respectively corresponding to each of the point groups in a Hough voting space, and when adding a voting value to a position in the Hough voting space through which the plurality of loci passes, performing addition by varying the voting value based on a level difference between first and second signal levels respectively indicated by the two pieces of frequency decomposition information; and retrieving a position where the voting value becomes maximum to detect, from the two-dimensional data, a shape which corresponds to the retrieved position, which indicates a proportional relationship between the frequency component and the phase difference, and which is used to estimate a sound source direction of each of the acoustic signals.

BRIEF DESCRIPTION OF THE DRAWINGS

FIG. 6 is a diagram for explaining phase difference computation;

FIG. 7 is a diagram for explaining coordinate value calculation;

FIG. 13 is a diagram for explaining function values of average power to be voted;

DETAILED DESCRIPTION OF THE INVENTION

Hereinafter, embodiments of an acoustic signal processing apparatus according to the present invention will be described with reference to the drawings.

(Overall Configuration)

Figure 1:
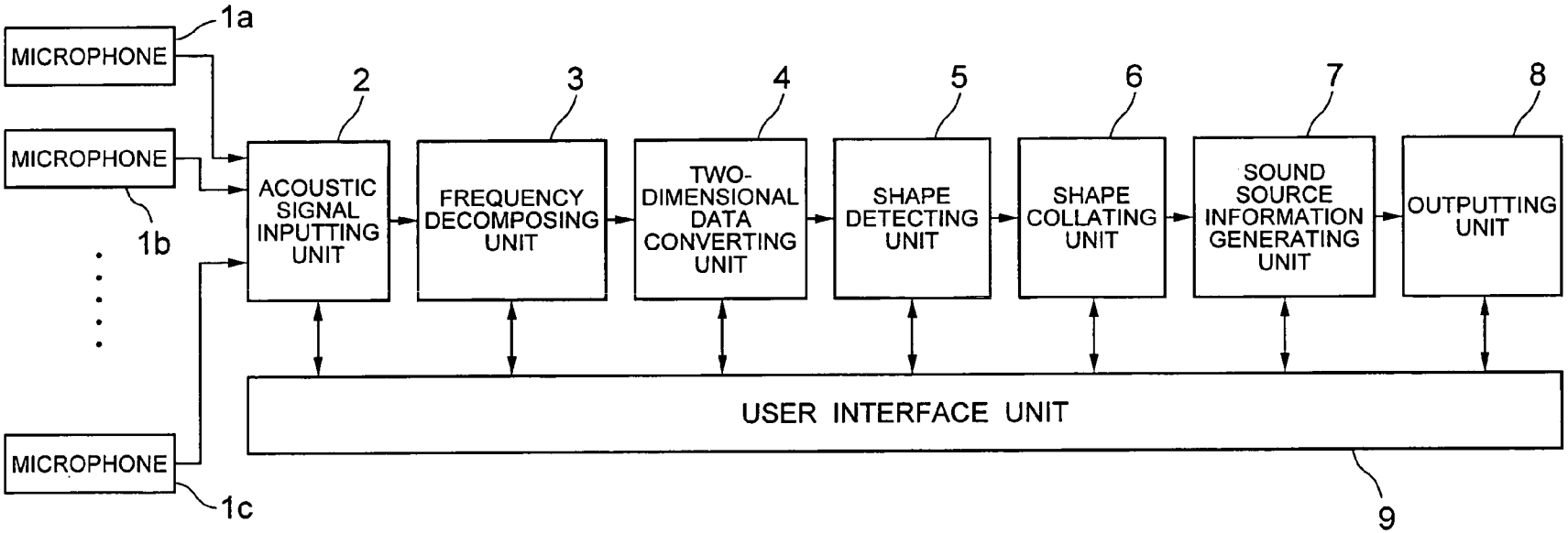
FIG. 1 is a functional block diagram according to an embodiment of the present invention.

FIG. 1 shows a functional block configuration of an acoustic signal processing apparatus according to a first embodiment of the present invention. The apparatus of the present invention includes: "n" number of microphones 1*a* to 1*c*, where "n" is three or more; an acoustic signal inputting unit 2; a frequency decomposing unit 3; a two-dimensional data converting unit 4; a shape detecting unit 5; a shape collating unit 6; a sound source information generating unit 7; an outputting unit 8; and a user interface unit 9.

The "n" number of microphones 1*a* to 1*c* form "m" number of pairs, where "m" is two or more, and each pair is a combination of two microphones that are different from each other. Amplitude data for "n" channels inputted via the microphones 1*a* to 1*c* and the acoustic signal inputting unit 2 are respectively converted into frequency decomposition information by the frequency decomposing unit 3. The two-dimensional data converting unit 4 calculates a phase difference for each frequency from the pair of two pieces of frequency decomposition information. The calculated per-frequency phase difference is given a two-dimensional coordinate value (x, y) and thus converted into two-dimensional data. By arranging the two-dimensional data in a temporal sequence, the data becomes three-dimensional data with an added temporal axis. The shape detecting unit 5 analyzes the generated two-dimensional data on an XY plane or the three-dimensional data in an XYT space with an added temporal axis to detect a predetermined shape. This detection is respectively performed on the "m" number of pairs. In addition, each of the detected shapes is candidate information that suggests the existence of a sound source. The shape collating unit 6 processes information on detected shapes, and estimates and associates shapes derived from a same sound source among sound source candidates of different pairs. The sound source information generating unit 7 processes the associated sound source candidate information to generate sound source information that includes: a number of sound sources; a spatial existence range of each sound source; a temporal existence duration of a sound emitted by each sound source; a component configuration of each source sound; a separated sound for each sound source; and symbolic contents of each source sound. The outputting unit 8 outputs the information, and the user interface unit 9 presents various setting values to a user, accepts setting inputs from the user, saves setting values to an external storage device, reads out setting values from the external storage device, and presents various information or various intermediate derived data to the user.

This acoustic signal processing apparatus is capable of detecting not only human voices but various sound sources from background noise, as long as the sound source emits a small number of intense frequency components or a large number of weak frequency components, and is also capable of detecting a number of sound sources that exceeds the number of microphones.

In this case, estimation of not only the direction of a sound source but also a spatial position thereof is made possible by performing, from a pair of microphones, an estimation of a number and directions of sound sources as sound source candidates, and collating and integrating results thereof for a plurality of pairs. In addition, with respect to a sound source that exists in a direction with conditions that are adverse in relation to a single microphone pair, high-quality extraction and identification of a source sound from data from a microphone pair under preferable conditions may be performed by selecting an appropriate microphone pair for a single sound source from a plurality of microphone pairs.

(Basic Concept of Sound Source Estimation Based on a Phase Difference of Each Frequency Component)

The microphones 1*a* to 1*c* are "n" number of microphones arranged with a predetermined distance between each other in a medium such as air, and are means for respectively converting medium vibrations (sound waves) at different "n" points into electrical signals (acoustic signals). The "n" number of microphones form "m" number of pairs, where "m" is two or more and where each pair is a combination of two microphones that are different from each other.

The acoustic signal inputting unit 2 is means for generating, as a time series, digitized amplitude data for "n" channels by periodically performing A/D conversion of acoustic signals of "n" channels from microphones 1*a* to 1*c* at a predetermined sampling period Fr.

Figure 2:
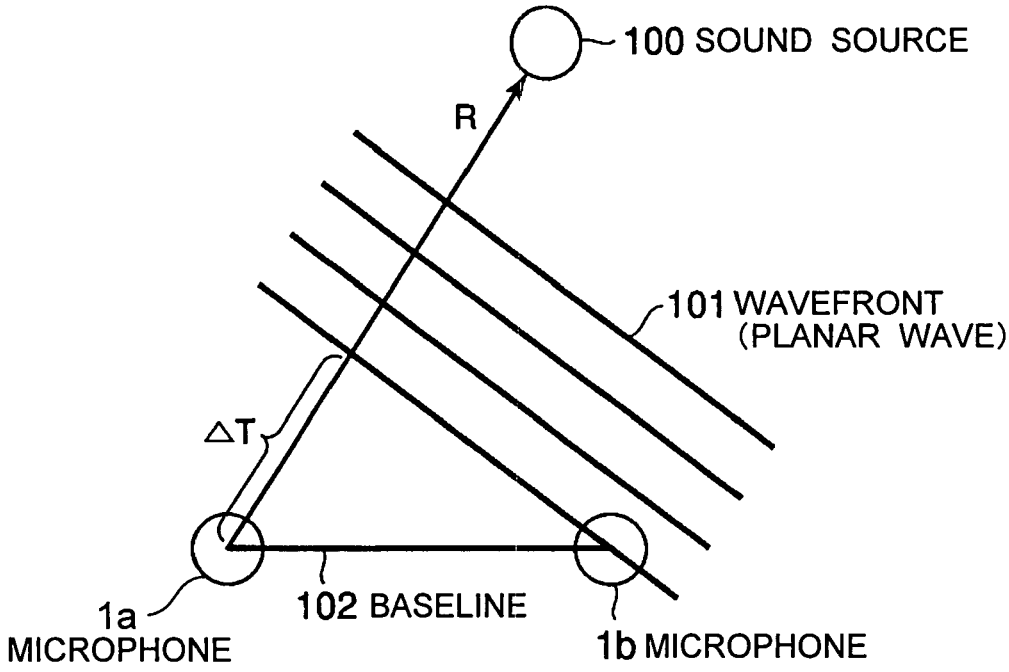
FIG. 2 is a diagram showing a relationship between sound source direction and differential arrival time.
Figure 2:
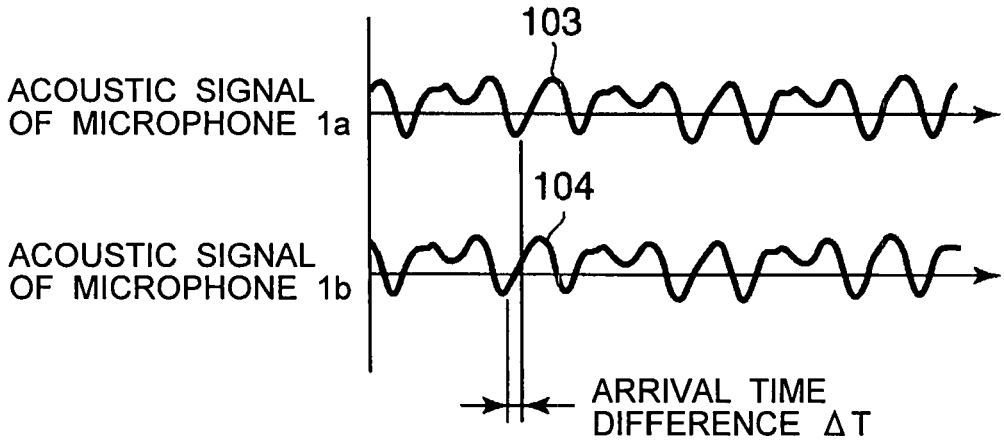

Assuming that the sound source is significantly distant in comparison to the distance between microphones, a wavefront 101 of a sound wave emitted by a sound source 100 and arriving at a microphone pair is substantially planar, as shown in FIG. 2. For instance, when observing this planer wave from two different positions using the microphones 1*a* and 1*b*, in accordance to a direction "R" of the sound source 100 with respect to a line segment 102 connecting both microphones (hereinafter referred to as a baseline), a predetermined arrival time difference ΔT should be observed between the acoustic signals converted by both microphones. Incidentally, when the sound source is significantly distant, the arrival time difference ΔT takes a value of 0 when the sound source 100 exists on a place that is perpendicular to the baseline 102. This direction shall be defined as the frontal direction of the microphone pair.

In Reference Document 1: Suzuki, Kaoru et al., "Realization of a 'Come When Called' F unction in Home Robots Using Visual Auditory Coordination", Collected Speeches and Papers from the 4th System Integration Division Annual Conference (SI2003) of The Society of Instrument and Control Engineers", 2F4-5, 2003, a method is disclosed for deriving an arrival time difference ΔT between two acoustic signals (reference numerals 103 and 104 in FIG. 2) by searching through pattern collation which portion of a piece of amplitude data is similar to which portion of another piece of amplitude data. However, while this method is effective when there is only one intense sound source, in a case where intense background noise or a plurality of sound sources exists, similar portions do not clearly appear on waveforms in which intense sounds from a plurality of directions coexist, and pattern collation may result in a failure.

In consideration thereof, the present embodiment is arranged to decompose and analyze inputted amplitude data into a phase difference for each frequency component. Through this arrangement, for a frequency component that is specific to each sound source, a phase difference corresponding to the direction of the sound source is observed between two pieces of data even when a plurality of sound sources exist. Therefore, if the phase differences for respective frequency components may be grouped in similar directions without having to assume a strong limitation on sound sources, it should be possible to understand, for a wider variety of sound source types, how many sound sources exist, in what directions are the respective sound sources located, and what kind of sound waves of characteristic frequency components are primarily emitted by the sound sources. While the logic itself is extremely straightforward, the actual analysis of data presents several challenges to be overcome. These challenges, together with a function block for performing this grouping (the frequency decomposing unit 3, the two-dimensional data converting unit 4 and the shape detecting unit 5), will be described below.

(Frequency Decomposing Unit 3)

A common method for decomposing amplitude data into frequency components is the fast Fourier transform (FFT). Known typical algorithms include the Cooley-Turkey DFT algorithm.

Figure 3:
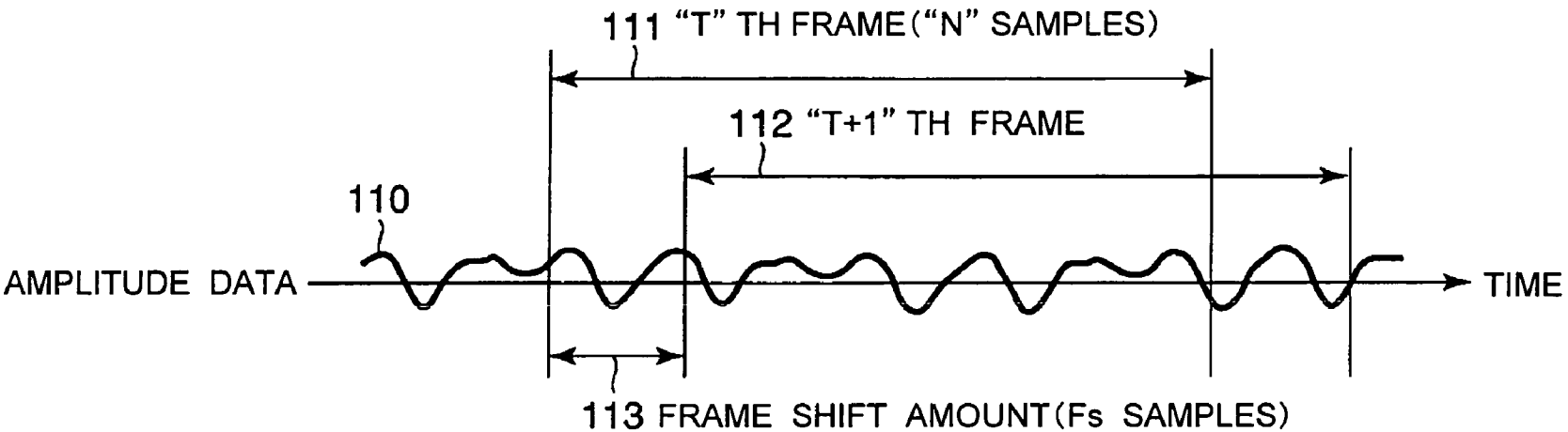
FIG. 3 is a diagram showing a relationship between frames and a frame shift amount.

As shown in FIG. 3, the frequency decomposing unit 3 performs fast Fourier transform on amplitude data 110 from the acoustic signal inputting unit 2 by extracting "N" number of consecutive amplitude data as a frame (a "T"th frame 111), and repeats the process by shifting the extraction position by a frame shift amount 113 (a T+1th frame 112).

Figure 4:
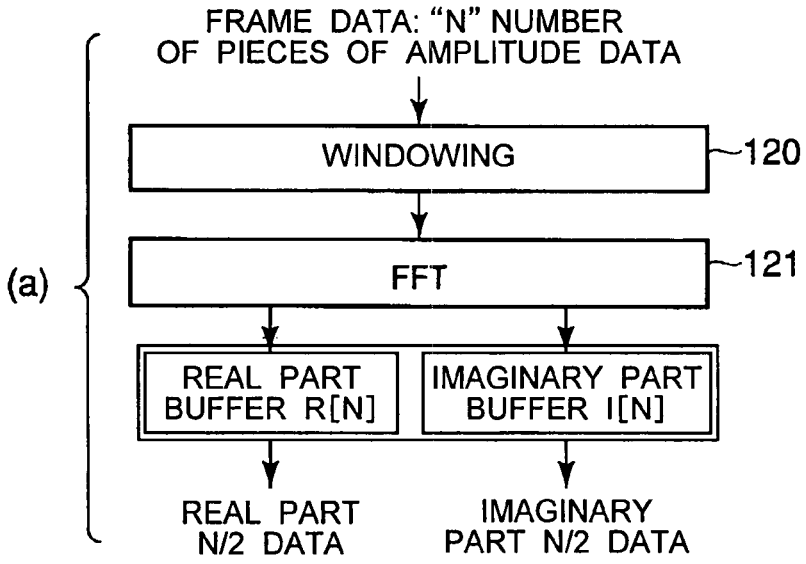
FIG. 4 is a diagram for explaining FFT processing and fast Fourier transform data.
Figure 4:
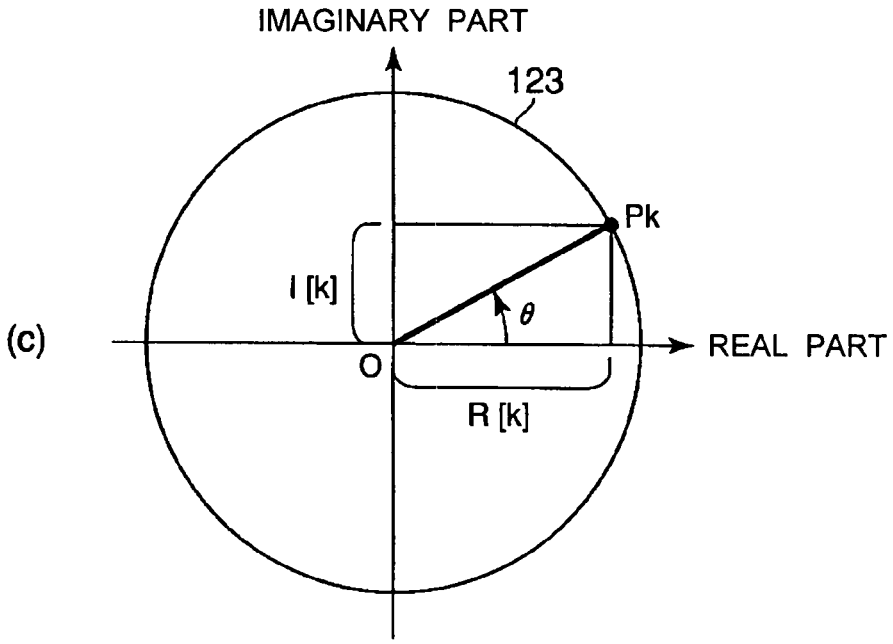

As shown in FIG. 4(*a*), amplitude data composing a frame is subject to windowing (reference numeral 120 in the diagram), and subsequently subject to fast Fourier transform (reference numeral 121 in the diagram). As a result, fast Fourier-transformed data of the inputted frame is generated as a real part buffer R[N] and an imaginary part buffer I[N] (reference numeral 122 in the diagram). Incidentally, a windowing function (Hamming windowing or Hanning windowing) is shown as reference numeral 124 in the diagram.

The fast Fourier-transformed data generated at this point is data obtained by decomposing the amplitude data of the relevant frame into N/2 number of frequency components, and is arranged so that a real part R[k] and an imaginary part I[k] within the buffer 122 for a "k"th frequency component fk represents a point Pk on a complex coordinate system 123, as shown in FIG. 4(*c*). The square of the distance of Pk from the origin "O" is a power Po (fk) of the frequency component, and the signed angle of rotation θ $\{\theta: -\pi>\theta\geqq\pi$ [radian]$\}$ from the real part axis of Pk is a phase Ph (fk) of the frequency component.

When the sampling frequency is given by Fr [Hz] and the frame length is given by "N" [samples], "k" takes an integer value ranging from 0 to (N/2)−1, where k=0 represents 0 [Hz] (a direct current) and k=(N/2)−1 represents Fr/2 [Hz] (the highest frequency component), and a frequency of each "k" is obtained by equally dividing therebetween by a frequency resolution $\Delta f=(Fr/2)/((N/2)-1)$ [Hz]. This frequency may be expressed as $fk=k\cdot\Delta f$.

Incidentally, as described earlier, the frequency decomposing unit 3 generates, as a time series, frequency-decomposed data made up of a power value and a phase value for each frequency of inputted amplitude data by consecutively performing this processing at predetermined intervals (the frame shift amount Fs).

(Two-Dimensional Data Converting Unit 4 and Shape Detecting Unit 5)

Figure 5:
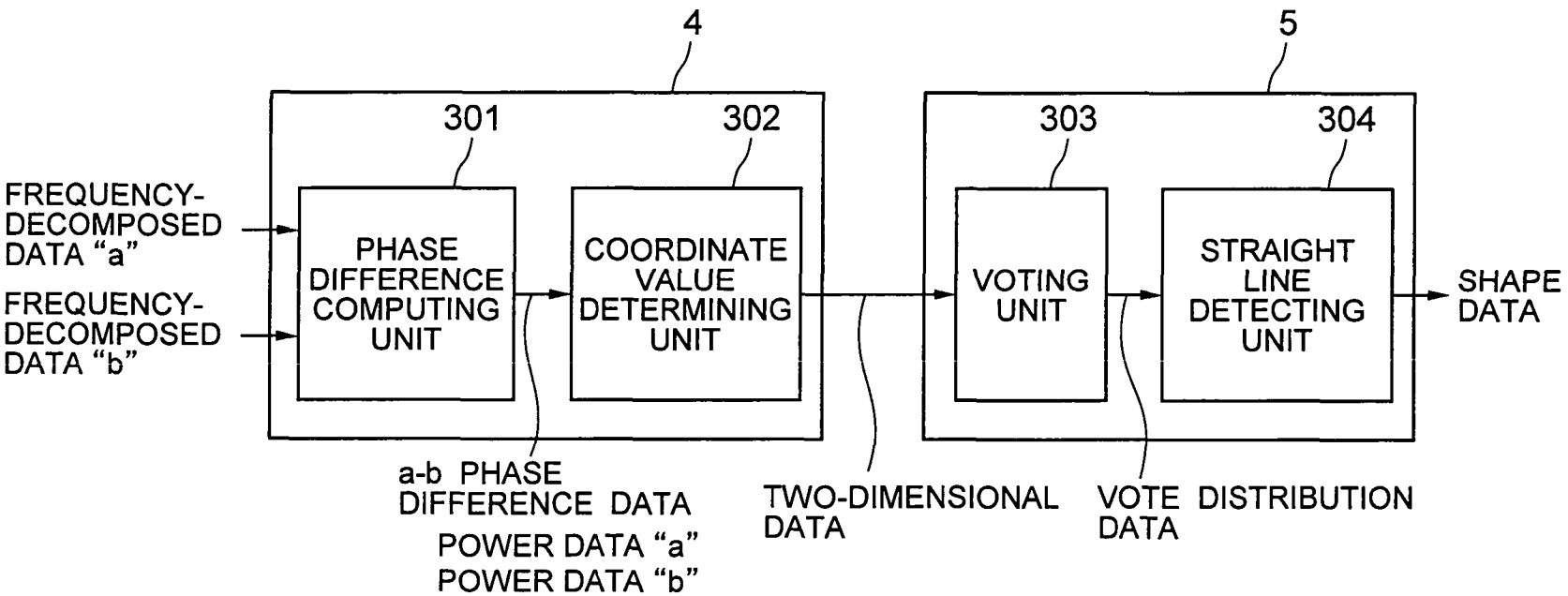
FIG. 5 is an internal configuration diagram of a two-dimensional data converting unit and a shape detecting unit.

As shown in FIG. 5, the two-dimensional data converting unit 4 includes a phase difference computing unit 301 and a coordinate value determining unit 302, while the shape detecting unit 5 includes a voting unit 303 and a straight line detecting unit 304.

(Phase Difference Computing Unit 301)

The phase difference computing unit 301 is means for comparing two pieces of frequency-decomposed data "a" and "b" for the same period obtained from the frequency decomposing unit 3 to generate a-b phase difference data obtained by calculating differences between phase values of "a" and "b" for the same respective frequency components. As shown in FIG. 6, the value of the phase difference ΔPh (fk) of a given frequency component fk is computed as a coset of 2π so as to fall within $\{\Delta Ph\ (fk): -\pi<\Delta Ph\ (fk)\leqq\pi\}$ by calculating the difference between the phase value Ph1 (fk) at the microphone 1*a* and the phase value Ph2 (fk) at the microphone 1*b*.

(Coordinate Value Determining Unit 302)

The coordinate value determining unit 302 is means for determining coordinate value for handling phase difference data obtained, based on phase difference data computed by the phase difference computing unit 301, by calculating the difference between both phase values on each frequency component as a point on a predetermined two-dimensional XY coordinate system. An X coordinate value "x" (fk) and a Y coordinate value "y" (fk) corresponding to the phase difference ΔPh (fk) for a given frequency component fk is determined by the formulas shown in FIG. 7. The X coordinate value is the phase difference ΔPh (fk), while the Y coordinate value is the frequency component number "k".

(Frequency Proportionality of Phase Differences With Respect to Same Temporal Difference)

Figure 8:
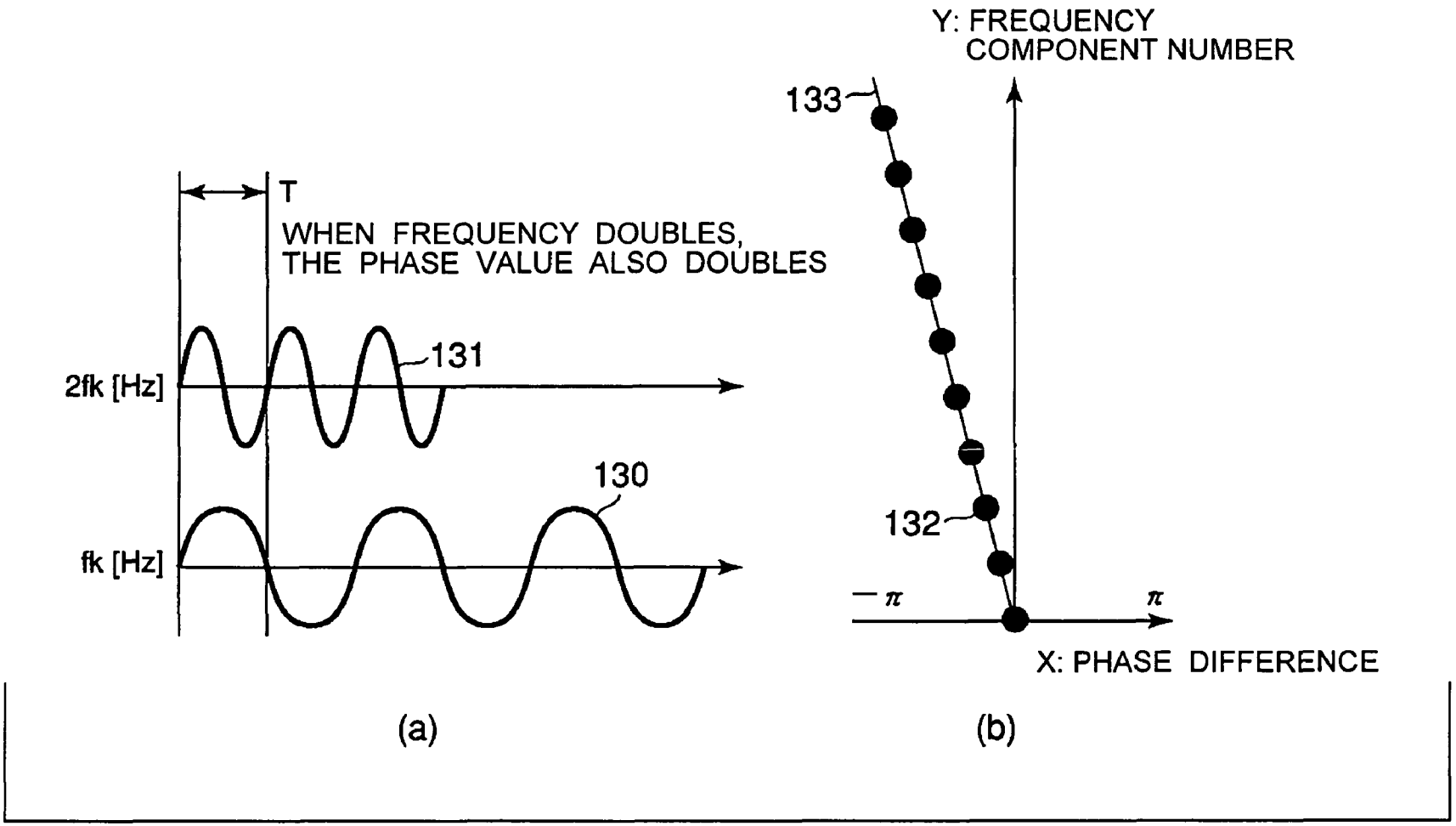
FIG. 8 is a diagram showing the proportional relationship between frequencies and phases with respect to the same time interval.

With the phase differences of respective frequency components that are computed by the phase difference computing unit 301 as shown in FIG. 6, phase differences derived from the same sound source (same direction) should represent the same arrival time difference. In this case, since the phase value of a given frequency and the phase difference between both microphones obtained by FFT are values computed by taking 2π as the cycle of the frequency, even for the same time difference, a proportional relationship exists in which the phase difference will double if the frequency is doubled. A representation thereof is shown in FIG. 8. As exemplified in FIG. 8(*a*), for the same time "T", a wave 130 having a frequency fk [Hz] includes a phase segment corresponding to ½ cycles or, in other words, π, while a wave 131 of a double frequency 2fk [Hz] includes a phase segment corresponding to one cycle or, in other words, 2π. The same relationship applies to phase differences, and the phase difference with respect to the same time difference ΔT will increase in proportion to the frequency. A schematic representation thereof is shown in FIG. 8(*b*). By plotting the phase differences of respective frequency components that are emitted from the same sound source and which share ΔT on a two-dimensional coordinate system using the coordinate value calculation shown in FIG. 7, it is shown that coordinate points 132 representing the phase differences of the respective frequency components line up on a straight line 133. The greater the value of ΔT or, in other words, the greater the difference between the distances to the sound source between both microphones, the greater the slope of the straight line.

(Circularity of Phase Difference)

However, phase differences between both microphones are proportional to frequencies across the entire range as shown in FIG. 8(*b*) only when the true phase difference from the minimum frequency to the maximum frequency of the analysis target does not deviate from ±π. This condition is that ΔT does not equal or exceed a time with a cycle that is ½ of the maximum frequency (half the sampling frequency) Fr/2 [Hz]

or, in other words, less than 1/Fr [seconds]. If ΔT equals or exceeds 1/Fr, the fact that phase differences may only be obtained as values with circularity must be considered as described below.

Figure 9:
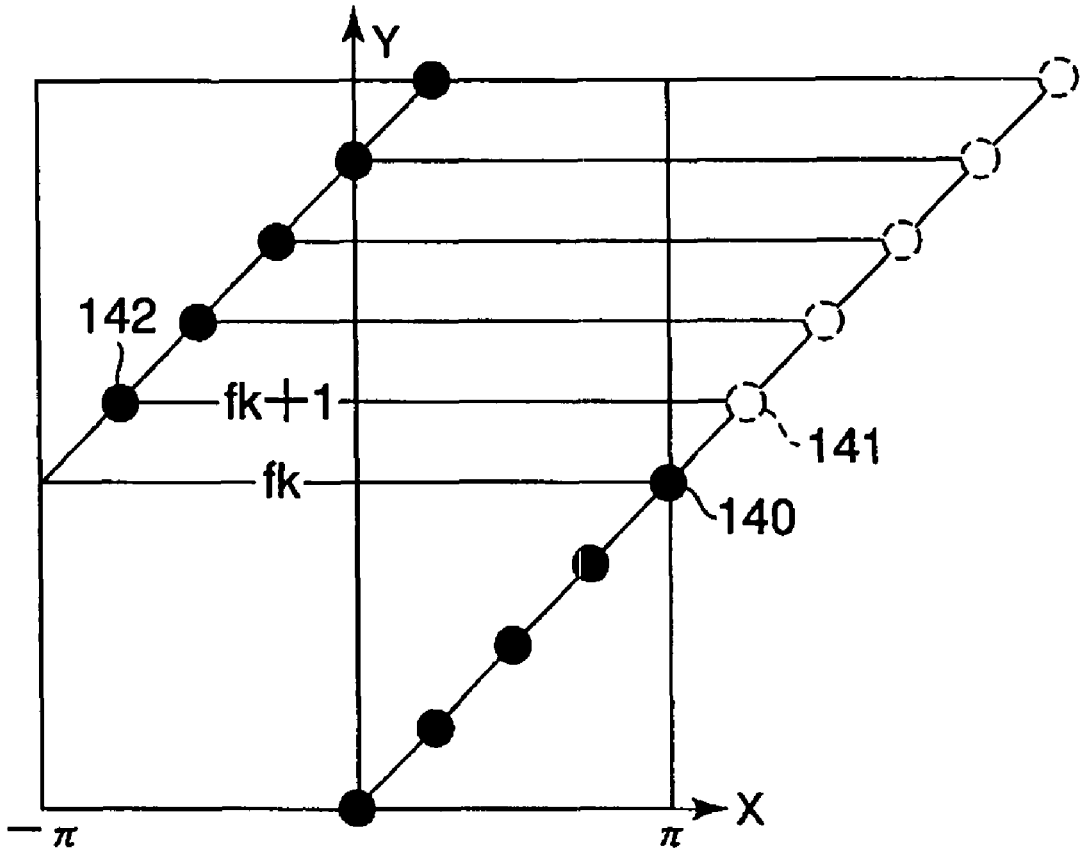
FIG. 9 is a diagram for explaining circularity in phase differences.

An available phase value of each frequency may only be obtained with a width of 2π as a value of the angle of rotation shown in FIG. 4 (in the present embodiment, the width of 2π from −π to π). This means that even if the actual phase difference between both microphones for the frequency component equals or exceeds one cycle, the fact thereof is unknowable from phase values obtained as a result of frequency decomposition. Therefore, the present embodiment is arranged so that phase differences are obtained between −π to π as shown in FIG. 6. However, it is possible that a true phase difference attributable to ΔT is a value obtained by adding 2π to or subtracting 2π from the phase difference calculated in this case, or even a value obtained by adding 4π or 6π to or subtracting 4π or 6π from the phase difference. A schematic representation thereof is shown in FIG. 9. In FIG. 9, when the phase difference ΔPh (fk) of a frequency fk takes a value of +π as indicated by a black dot 140 in the diagram, the phase difference of an immediately higher frequency fk+1 exceeds +π, as indicated by a white dot 141 in the diagram. However, a calculated phase difference ΔPh (fk+1) will take a value that is slightly larger than −π obtained by subtracting 2π from the original phase difference, as indicated by a black dot 142 in the diagram. Furthermore, while not shown, while the same value will be obtained from a three-fold frequency, in reality, this is a value obtained by subtracting 4π from the actual phase difference. As shown, as frequencies increase, phase differences recur as a coset of 2π between −π and π. As shown by this example, as ΔT increases, from a given frequency fk+1 and higher, true phase differences indicated by the white dots will recur to the opposite side as indicated by the black dots.

(Phase Difference when a Plurality of Sound Sources Exists)

Figure 10:
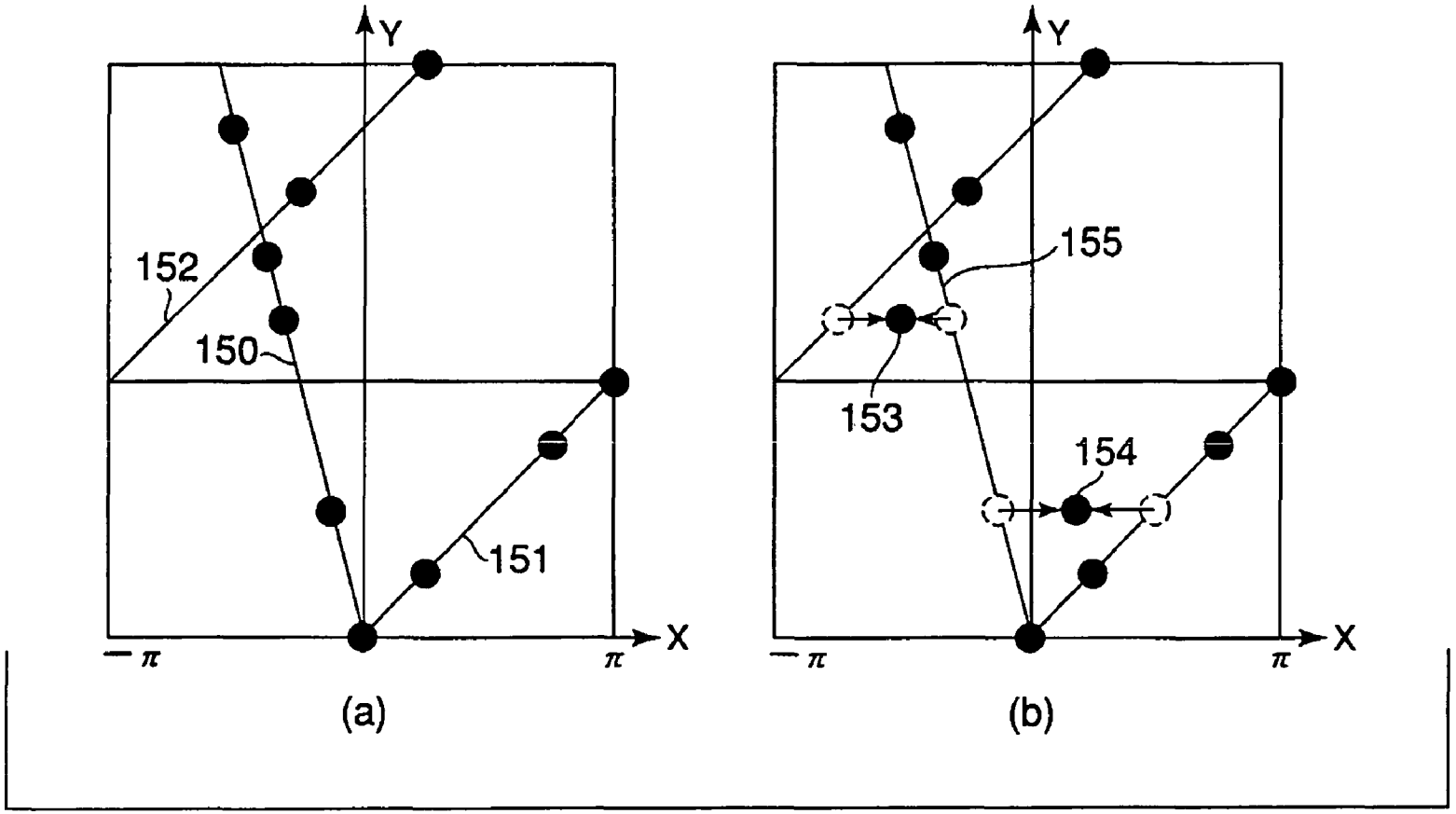
FIG. 10 is a plot diagram when a plurality of sound sources exists.

On the other hand, in a case where sound waves are emitted from a plurality of sound sources, a plot diagram of frequencies and phase differences will appear as schematically shown in FIG. 10. FIG. 10 shows cases where two sound sources respectively exist in different directions with respect to a microphone pair. FIG. 10(*a*) represents a case where the two source sounds do not include the same frequency components, while FIG. 10(*b*) represents a case where a frequency component of a source sound is included in both. In FIG. 10(*a*), the phase differences of the respective frequency components rest on any of the straight lines sharing ΔT. Five points are arranged on a straight line 150 having a gentle slope, while six points are arranged on a straight line 151 (including a recurring straight line 152) having a steep slope. In FIG. 10(*b*), since mixed waves occur at the two mutually included frequency components 153 and 154 and phase differences are not properly revealed, phase differences are less likely to rest on either straight line. In particular, only three points are arranged on a straight line 155 having a gentle slope.

The issue of estimating the number and directions of sound sources according to the present embodiment boils down to the issue of discovering straight lines such as those shown in such plot diagrams. In addition, the issue of estimating the frequency components for each sound source boils down to the issue of selecting frequency components that are arranged at positions in the proximity of the detected straight lines. In consideration thereof, two-dimensional data outputted by the two-dimensional data converting unit 4 according to the apparatus of the present embodiment is arranged as a point group determined as a function of a frequency and a phase difference using two of the pieces of frequency-decomposed data from the frequency decomposing unit 3, or as an image obtained by arranging (plotting) the point group onto a two-dimensional coordinate system. Incidentally, the two-dimensional data is defined by two axes excluding a temporal axis, and as a result, three-dimensional data as a time series of two-dimensional data may be defined. It is assumed that the shape detecting unit 5 detects a linear arrangement from point group arrangements obtained as such two-dimensional data (or three-dimensional data as time series thereof) as a shape.

(Voting Unit 303)

The voting unit 303 is means for applying, as will be described later, Linear Hough transform to each frequency component given (x, y) coordinates by the coordinate value determining unit 302, and voting a locus thereof onto a Hough voting space according to a predetermined method. While Hough transform is described on pages 100 to 102 in Reference Document 2: Okazaki, Akio, "Image Processing for Beginners", Kogyo Chosakai Publishing, Inc., published Oct. 20, 2000, a re-outline will now be provided.

(Linear Hough Transform)

Figure 11:
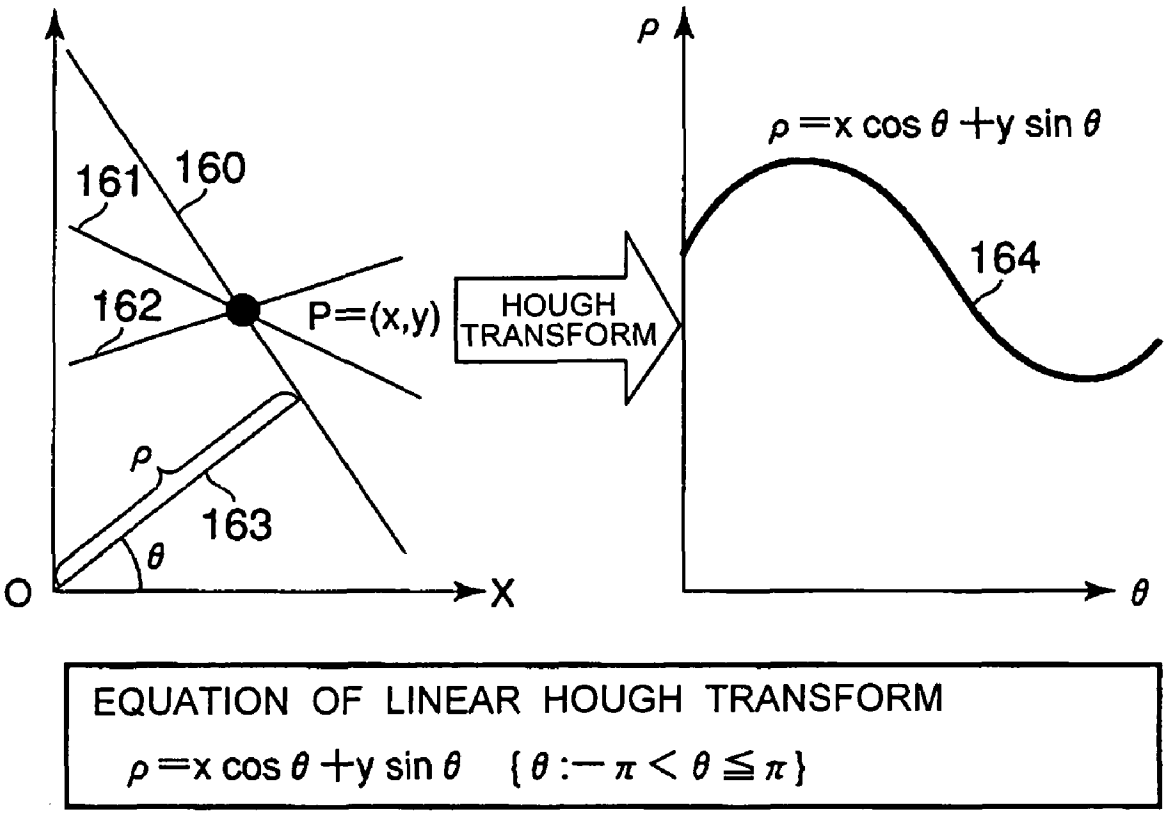
FIG. 11 is a diagram for explaining linear Hough transform.

As schematically shown in FIG. 11, while there exists infinite straight lines that may pass through point p(x, y) on a two-dimensional coordinate system as exemplified by reference numerals 160, 161 and 162 on the diagram, it is known that, by respectively expressing the slope of a normal 163 drawn from the origin "O" to each straight line with respect to the X axis as θ and the length of the normal 163 as ρ, θ and ρ are uniquely determined for a single straight line, and the possible combinations of θ and ρ which may be taken by a straight line passing a given point (x, y) describe a locus 164 ($\rho = x\cos\theta + y\sin\theta$) that is unique to the values of (x, y) on a θρ coordinate system. Such a conversion of (x, y) coordinate values to a locus of (θ, ρ) of a straight line that may pass through (x, y) is referred to as Hough transform. Incidentally, it is assumed that θ will take a positive value when the straight line is sloped towards the left, 0 when perpendicular, and a negative value when the straight line is sloped towards the right, and the domain of θ will not fall outside $\{\theta: -\pi<\theta\leqq\pi\}$.

Figure 12:
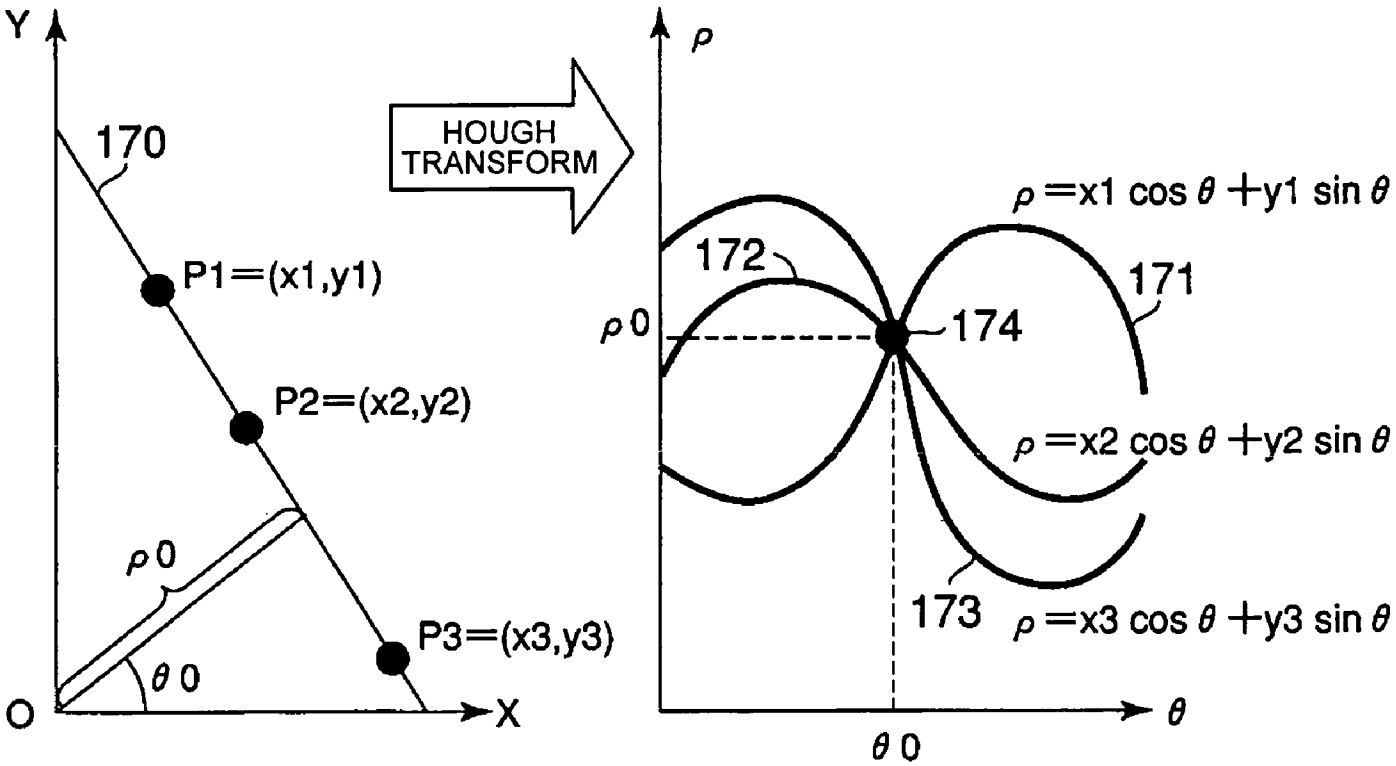
FIG. 12 is a diagram for explaining that loci intersect each other at one point when there is a straight line passing through a plurality of points.

While a Hough curve may be independently obtained for each point on an XY coordinate system, as shown in FIG. 12, a straight line 170 commonly passing through, for instance, the three points of p1, p2 and p3 may be obtained as a straight line defined by the coordinates (θ0, ρ0) of a point 174 at which loci 171, 172 and 173 corresponding to p1, p2 and p3 intersect each other. The larger the number of points that a straight line passes through, the larger the number of loci passes through the positions of θ and ρ representing the straight line. As seen, Hough transform is suitable for applications in which a straight line is detected from a point group.

(Hough Voting)

The engineering method referred to as Hough voting is used for detecting a straight line from a point group. This method arranges voting to be performed on sets of θ and ρ through which each locus passes in a two-dimensional Hough voting space having θ and ρ as its coordinate axes to cause a position having a large number of votes in the Hough voting space suggest a set of θ and ρ through which a significant number of loci passes through or, in other words, suggest the presence of a straight line. Generally, a two-dimensional array (Hough voting space) having a sufficient size as a necessary retrieval range for θ and ρ is first prepared and initialized by 0. Next, a locus for each point is obtained through Hough transform, and a value on the array through which the locus passes through is incremented by one. This procedure is referred to as Hough voting. Once voting on loci is completed for all points, it is determined that: straight lines do not exist at a position having no votes (through which no loci passes), a straight line passing through a single point exists at a position having one vote (through which one loci passes); a straight line passing through two points exists at a position having two votes (through which two loci passes); and a straight line passing through "n" number of points exists at a position having "n" number of votes (through which "n" number of loci passes). If the resolution of the Hough voting space may reach infinite, as described above, only a point through which loci passes will gain a number of votes corresponding to the number of loci passing through that point. However, since an actual Hough voting space is quantized with respect to θ and ρ using a suitable resolution, a high vote distribution will also occur in the periphery of a position at which a plurality of loci intersect each other. Therefore, it will be required that positions at which loci intersect are obtained with greater accuracy by searching for positions having a peak value from the vote distribution in the Hough voting space.

The voting unit 303 performs Hough voting on frequency components that fulfill all conditions presented below. Under such conditions, only frequency components in a predetermined frequency band and having power equal to or exceeding a predetermined threshold will be voted.

(Voting condition 1) Components for which frequencies are within a predetermined range (low and high frequency cut-off)

(Voting condition 2) Components fk for which a power P (fk) thereof is equal to or exceeds a predetermined threshold Voting condition 1 is used for the purposes of cutting off low frequencies that generally carry dark noise and high frequencies in which the accuracy of FFT declines. Ranges of low and high frequency cutoff are adjustable according to operations. In a case of using a widest possible frequency band, a suitable setting will involve cutting off only direct current components as a low frequency and omitting only the maximum frequency as a high frequencies.

It is contemplated that the reliability of FFT results is not high for extremely weak frequency components comparable to dark noise. Voting condition 2 is used for the purpose of disallowing such frequency components with low reliability from participating in voting by performing threshold processing using power. Assuming that the microphone 1*a* has a power value of Po1 (fk) and the microphone 1*b* has a power value of Po2 (fk), there are three conceivable methods for determining power P (fk) to be evaluated at this point. Incidentally, the condition to be used may be set according to operations.

(Average Value): The Average Value of Po1 (fk) and Po2 (fk)

This condition requires that both powers to be moderately strong.

(Minimum value): The smaller of Po1 (fk) and Po2 (fk)

This condition requires that both powers to be at least equal to or greater than a threshold.

(Maximum value): The greater of Po1 (fk) and Po2 (fk)

Under this condition, voting will be performed even if one power is less than a threshold when the other is sufficiently strong.

In addition, the voting unit 303 is capable of performing the two addition methods described below during voting.

(Addition method 1) Adding a predetermined fixed value (e.g. 1) to a passed position of a locus.

(Addition method 2) Adding a function value of power P (fk) of the frequency component fk to a passed position of a locus.

Addition method 1 is a method that is commonly used with respect to the issue of straight line detection using Hough transform, and since votes are ranked in proportion to the number of passed points, the method is suitable for preferentially detecting straight lines (in other words, sound sources) which includes many frequency components. In this case, since no limitations (requiring that included frequencies are arranged in regular intervals) are imposed on the harmonic structure of frequency components included in straight lines, it is possible to detect not only human sounds but a wider variety of sound sources.

In addition, addition method 2 is a method that allows a superordinate peak value to be obtained if a frequency component with high power is included, even when the number of passed points is small. The method is suitable for detecting straight lines (in other words, sound sources) having dominant components with high power even if the number of frequency components is small. The function value of power P(fk) according to the addition method 2 is calculated as G(P(fk)). FIG. 13 shows a calculation formula of G(P(fk)) when P(fk) is assumed to be an average value of Po1(fk) and Po2(fk). Alternatively, it is also possible to calculate P(fk) as a minimum value or a maximum value of Po1(fk) and Po2(fk) in the same manner as the voting condition 2 described earlier, and may be set according to operations independent from the voting condition 2. The value of an intermediate parameter "V" may be calculated as a value obtained by adding a predetermined offset a to a logarithmic value $\log_{10}(P(fk))$ of P(fk). Moreover, it is assumed that the function G(P(fk)) takes a value of V+1 when "V" is positive, and a value of 1 when "V" is equal to or less then zero. By casting a vote of at least 1 in this manner, it is now possible to combine the majoritarian characteristic of addition method 1 where not only will straight lines (sound sources) including frequency components with high power rise to the top of the ranking, but straight lines (sound sources) including a large number of frequency components will also rise to the top of the ranking. While the voting unit 303 is capable of performing either the addition method 1 or the addition method 2 according to settings, in particular, by using the latter, it is now possible to simultaneously detect a sound source with a small number of frequency components.

Accordingly, an even wider variety of sound source types will be detectable.

(Sound Source Specification (Sound Source Direction Estimation) Processing According to the Present Embodiment))

During sound source direction estimation processing, in the event that Hough transform is performed on a frequency-phase difference space mapped using an arbitrary frame and, for instance, voting is performed by setting the voting value to a constant value (maximum value or minimum value) when voting to the voting space, a problem arises in that sound source direction will not be estimated correctly if the sound volume level difference of sound data between microphones is significant.

This problem occurs because information on which of the microphones has acquired a sound volume level that is greater by how much has not been reflected. In other words, while voting values will differ for each frequency by using the above-described addition method 2, the fact that the same voting value will be cast for all angles for the same frequency will result in information regarding sound volume level differences not being reflected onto the results of sound source direction estimation processing.

In comparison, in the present embodiment, IID (Interaural Intensity Difference) is introduced for estimating sound source directions. For instance, when voting a point in a phase difference-frequency space using Hough transform in order to estimate sound source directions in a microphone array composed of two microphones "a" and "b", voting values are modified according to the θ value that is the slope of a straight line passing through that point.

Sound volume level values respectively obtained at the two microphones "a" and "b" are used as the parameters of this modification. For instance, if the microphone "a" has a greater sound volume level value than microphone "b", by increasing the voting value when the θ value of the slope indicates a direction towards microphone "a" and reducing the voting value when the θ value of the slope indicates a direction towards microphone "b", the IID element may be introduced to straight line detection using Hough transform and, as a result, sound source direction may be estimated with good accuracy.

Incidentally, the θ value representing the slope of a straight line in a frequency-phase difference space corresponds to a sound source direction. By performing a predetermined computation processing on the θ value representing the slope of a straight line, a sound source direction may be computed.

Figure 14:
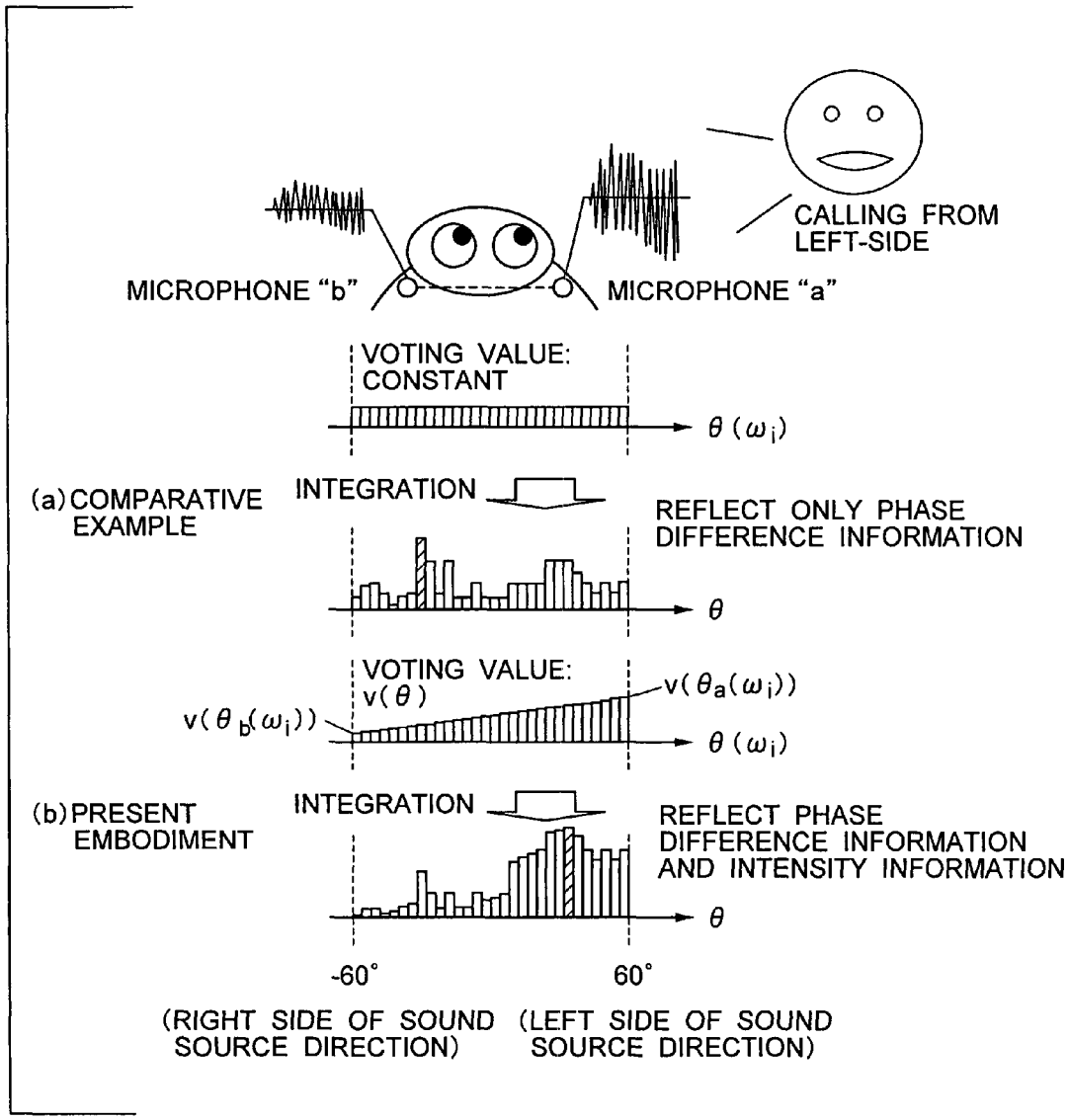
FIG. 14 is a view showing uses of Hough voting values based on IID.

With reference to FIG. 14(*a*), a description will now be provided on a procedure of sound source specification processing using Hough transform in a case where voting is performed using a constant voting value.

First, FFT processing is respectively performed on sound source waveform data inputted to two microphones (microphones "a" and "b") configuring a microphone array, and intensity values (in other words, signal levels indicating sound volume level values) for the respective frequencies are obtained as Ia(ω) and Ib(ω).

Next, for an arbitrary frequency $\omega_i$, an average value $$\frac{I_a(\omega_i)+I_b(\omega_i)}{2} \quad \text{[Formula 1]}$$

of the intensity values of the microphones "a" and "b" at that frequency is computed, and is deemed to be a Hough voting value V(ωi). Alternatively, a maximum value $\max(I_a(\omega i), I_b(\omega i))$ of the intensity values of the microphones "a" and "b" at that frequency is computed, and is deemed to be a Hough voting value $V(\omega_i)$.

Subsequently, straight line detection processing using Hough transform will be applied to the frequency-phase difference space. In doing so, $V(\omega_i)$ will be used as the voting value.

In other words, based on the frequency $\omega_i$ and a phase difference value $\Delta\phi(\omega_i)$ between the microphones "a" and "b" at the frequency $\omega_i$ (already computed through FFT processing), a single point is determined in the frequency-phase difference space. Among the straight lines passing through the point determined in the frequency-phase difference space, a distance ρ between the origin and each of 61 straight lines having slopes θ that fall under a range of $-60° \leqq \theta \leqq 60°$ (in 2° intervals) is computed, and voting values $V(\omega_i)$ are integrated for 61 points (θ, ρ) in the θ-ρ space. Incidentally, the initial value of the voting value at each point in the θ-ρ space is 0. In addition, when computing distances ρ, such distances may be referenced from a table of ρ values calculated in advance.

Then, for all frequencies $\omega_i$, Hough transform from $(\omega_i, \Delta\phi(\omega_i))$ to (θ, ρ) and voting on the θ-ρ space (using voting value $V(\omega_i)$) are performed. Subsequently, after sound input, since synchronism upon A/D conversion is guaranteed by a dedicated board, the straight line to be calculated will inevitably pass the origin (ω=0, phase difference of the direct current component is 0). Therefore, a voting value sequence with respect to the θ value is created by extracting voting values (values on the θ axis) in the portion of ρ=0. However, since phase difference possesses circularity ($\Delta\phi=\Delta\phi_0+2k\pi$, $k=0, \pm1, \pm2, \ldots$), if a straight line with the same $\theta_0$ exists, such a straight line will be integrated into the extracted voting value sequence.

Using this voting value sequence, a straight line in the frequency-phase difference space representing a point (θ, ρ) having the highest voting value is calculated as a straight line representing a relationship between the frequency of sound arriving from the sound source and the phase difference between the microphones "a" and "b". The relationship indicates the direction of the sound source. In addition, when it is conceivable that two or more sound sources exist, points (θ, ρ) having the second highest and lower voting values are calculated to obtain directions of respectively corresponding sound sources.

Incidentally, as shown in FIG. 14(*b*), in the case of the present embodiment, voting values vary according to slopes θ of straight lines in the frequency-phase difference space. Therefore, using the calculation formula provided above and assuming that $\theta_a=-60°$ and $\theta_b=60°$, voting values may be calculated by

[Formula 2]

$$V(\omega_i, \theta) = \frac{I_b(\omega_i) - I_a(\omega_i)}{\theta_b - \theta_a} \cdot \theta + I_a(\omega_i) \quad (1)$$

where $-60° \leqq \theta \leqq 60°$ (in 2° intervals).

For Hough transform from $(\omega_i, \Delta\phi(\omega_i))$ to (θ, ρ), the same procedures as described above will be followed. During voting, voting values $V(\omega_i, \theta)$ will be integrated for 61 points (θ, ρ) in the θ-ρ space. Incidentally, the initial value of each point in the θ-ρ space is assumed to be 0. At this point, since $V(\omega_i, \theta)$ will take a value corresponding to each θ value, calculation will be performed on a case-by-case basis. In this case, since the intensity value of the microphone "a" is larger than that of the microphone "b" ($I_a(\omega)>I_b(\omega)$), the microphone "a"-side end will have the highest value ($I_a(\omega)$), and voting values will gradually decrease towards the microphone "b"-side end, where $I_b(\omega)$ that is the lowest value will be cast.

Figure 15:
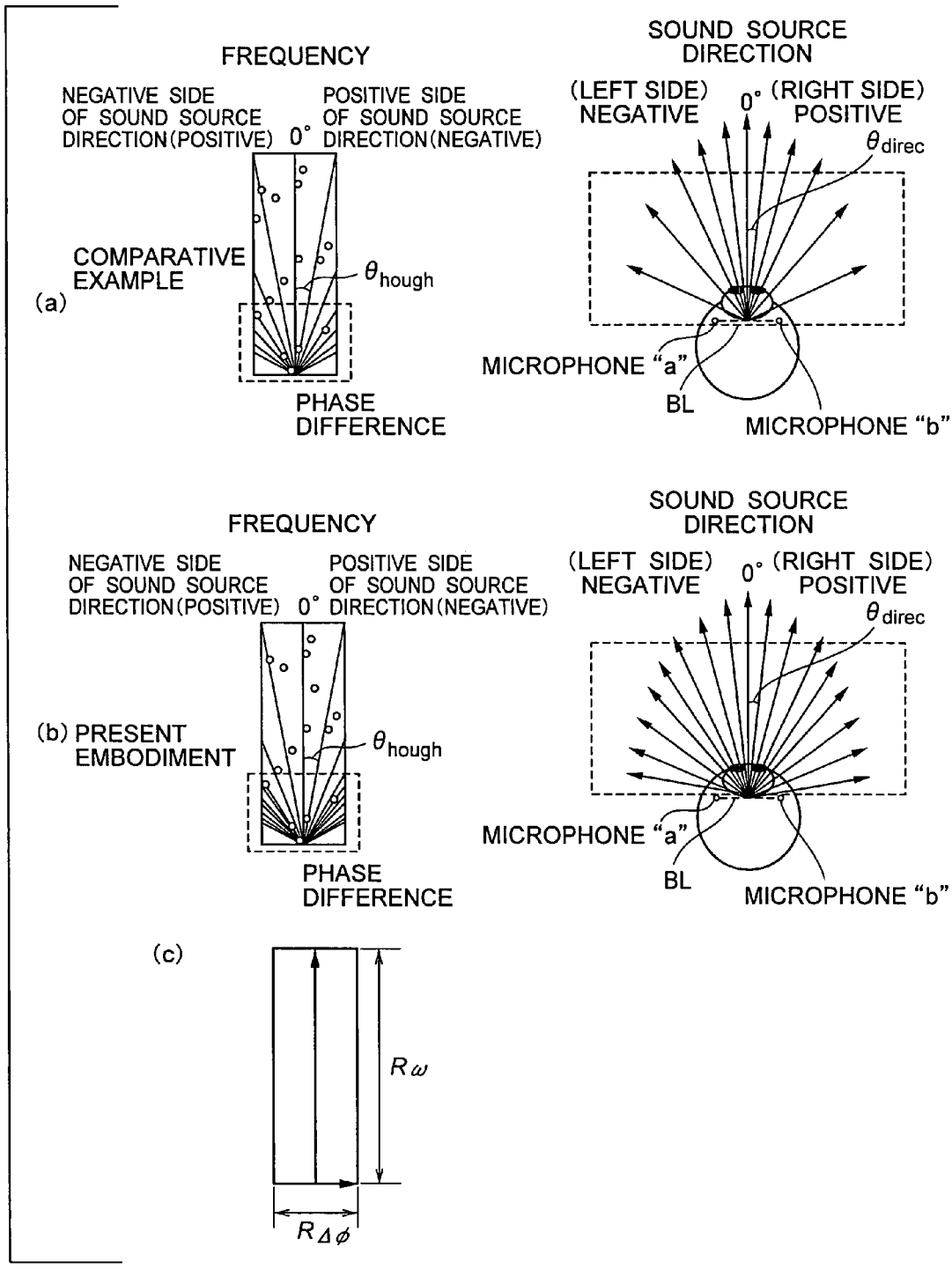
FIG. 15 is a view showing distributions of θ values voted by Hough voting and resultant actual directional θ values.

Incidentally, as shown in FIG. 15, in a case where a microphone array is configured by two microphones, the directional angle detection resolution in the vicinity of the direction (the direction of 0° in the diagram) perpendicular to a straight line BL connecting the two microphones (referred to as the baseline) differs from the directional angle detection resolution in the vicinity of the direction of the baseline BL. Therefore, problems arise in that angle accuracy will differ according to sound source position, and that even when performing sound source specification using a plurality of mike arrays, nonuniformity thereamong will have a significant effect on the ultimate accuracy.

Conversely, according to the present embodiment, the resolution of the $\theta_{hough}$ value (the slope of a straight line in the frequency-phase difference space) when performing Hough transform is arranged to be nonuniform such that a uniform resolution of an ultimately computed sound source direction value $\theta_{direc}$ is achieved. The relationship between $\theta_{hough}$ and $\theta_{direc}$ may be expressed as

[Formula 3]

$$\theta_{direc} = \sin^{-1}\left(\frac{V}{d_{a-b}} \cdot \frac{1}{(f_s/2)} \cdot (-\tan\theta_{hough}) \cdot \frac{R_\omega}{R_{\Delta\phi}}\right) \quad (2)$$

where sonic velocity is represented by "V", distance between the microphones "a" and "b" is represented by $d_{a-b}$, frequency is represented by $\omega_i$, and only cases where the value within the brackets is [−1, 1] will be considered. In addition, sampling frequency during sound acquisition is represented by $f_s$, while a range of $\Delta\phi,\omega$ on the phase difference-frequency plane (the range subsequent to non-dimensionalization) is represented by $R_{\Delta\phi}$, $R_\omega$.

Using the formula below that is obtained by performing inverse expansion on the above with respect to $\theta_{hough}$, $\theta_{hough}$ values calculated when $\theta_{direc}$ are equally spaced are obtained to be used when performing Hough transform. This allows source direction values $\theta_{direc}$ that are computed using Formula 3 after determining a straight line using the $\theta_{hough}$ value that has attached the most number of votes through voting to be computed at even intervals.

[Formula 4]

$$\theta_{hough} = \tan^{-1}\left(-\frac{d_{a-b}}{V} \cdot (f_s/2) \cdot \sin\theta_{direc} \cdot \frac{R_{\Delta\phi}}{R_\omega}\right) \quad (3)$$

FIG. 15(*a*) shows a case where the resolution of $\theta_{hough}$ values is uniform. In this case, calculation is performed by setting the range of $\theta_{hough}$ to $-60° \leqq \theta_{hough} \leqq 60°$ (in 2° intervals). Assuming now that the frontal direction is 0°, the right side is positive and the left side is negative, the direction of a sound source may be expressed using $\theta_{direc}$ as

[Formula 5]

$$\theta_{direc} = \sin^{-1}\left(\frac{\left(\frac{\Delta\phi}{2\pi\omega_i}\right)}{\left(\frac{d_{a-b}}{V}\right)}\right), \quad (4)$$

$$\frac{\Delta\phi}{2\pi} \cdot R_{\Delta\phi} = (-\tan\theta_{hough}) \cdot \frac{\omega_i}{(f_s/2)} \cdot R_\omega + 2k\pi$$

where sampling frequency upon sound acquisition is represented by $f_s$, and a range of $\Delta\phi,\omega$ on the phase difference-frequency plane (the range subsequent to non-dimensionalization) is represented by $R_{\Delta\phi}$, $R_\omega$ (refer to FIG. 15(*c*)).

If k=0, a relational expression of $\theta_{hough}$ and $\theta_{direc}$ may be obtained as

[Formula 6]

$$\theta_{direc} = \sin^{-1}\left(\frac{V}{d_{a-b}} \cdot \frac{1}{(f_s/2)} \cdot (-\tan\theta_{hough}) \cdot \frac{R_\omega}{R_{\Delta\phi}}\right) \quad (5)$$

An inverse expansion thereon will result in

[Formula 7]

$$\theta_{hough} = \tan^{-1}\left(-\frac{d_{a-b}}{V} \cdot (f_s/2) \cdot \sin\theta_{direc} \cdot \frac{R_{\Delta\phi}}{R_\omega}\right) \quad (5)$$

From the above, by calculating $\theta_{hough}$ using $-90° \leqq \theta_{direc} \leqq 90°$ (in 2° intervals), a $\theta_{hough}$ value sequence having nonuniform intervals will be obtained, as shown in FIG. 15(*b*). In other words, resolution will be enhanced in a range where the absolute value of the $\theta_{hough}$ value is large.

Figure 16:
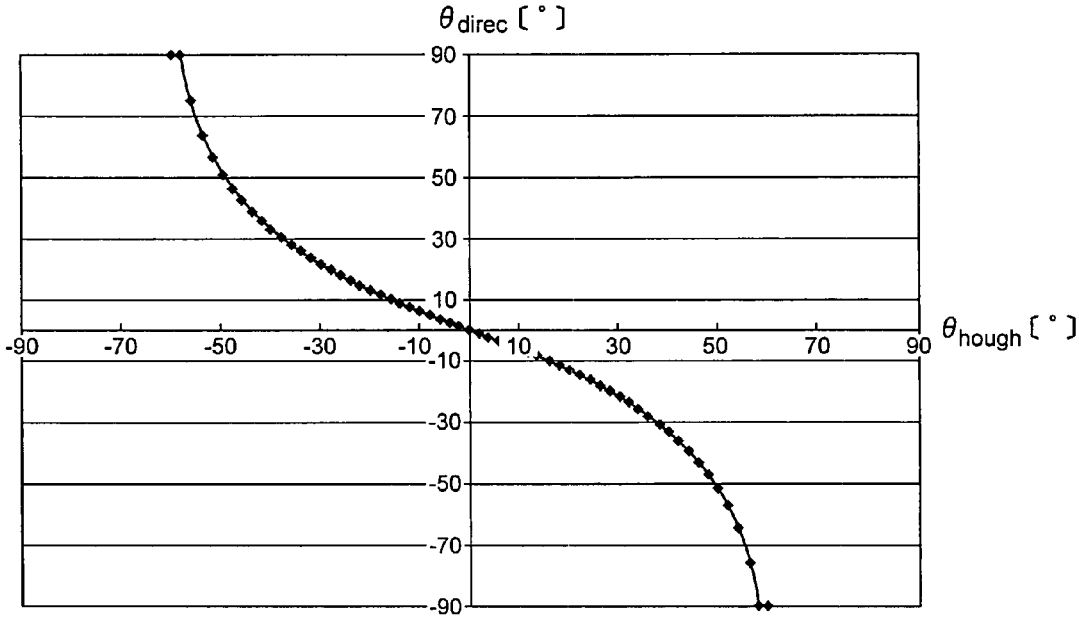
FIG. 16 is a graph of a relational expression between $\theta_{hough}$ and $\theta_{direc}$.

Using the $\theta_{hough}$ value as a slope of a straight line in the frequency-phase difference space, ρ is calculated, voting is performed, and the result is outputted as an extracted straight line with respect to a point having the highest voting value. As a result, by transforming a $\theta_{hough}$ value into a $\theta_{direc}$ value that indicates the direction of a sound source, a $\theta_{direc}$ value having a uniformly segmented resolution may be obtained (FIG. 15(*b*)). This transform from a $\theta_{hough}$ value into a $\theta_{direc}$ value is performed by the shape collating unit 6. The relationship between $\theta_{hough}$ and $\theta_{direc}$ is shown in FIG. 16.

(Collective Voting of a Plurality of FFT Results)

Furthermore, while the voting unit 303 is also capable of performing voting for every FFT, generally, it is assumed that voting will be performed collectively on "m" number (m≧1) of consecutive FFT results forming a time series. While frequency components of a sound source will vary in the long term, the above arrangement will enable more reliable Hough voting results to be obtained using a greater number of data obtained from FFT results for a plurality of time instants within a reasonably short duration having stable frequency components. Incidentally, the above "m" may be set as a parameter according to operations.

(Straight Line Detecting Unit 304)

The straight line detecting unit 304 is means for analyzing vote distribution on the Hough voting space generated by the voting unit 303 to detect dominant straight lines. At this point, straight line detection with higher accuracy may be realized by taking into consideration circumstances that are specific to the present issue, such as the circularity of phase differences described with reference to FIG. 9.

Figure 17:
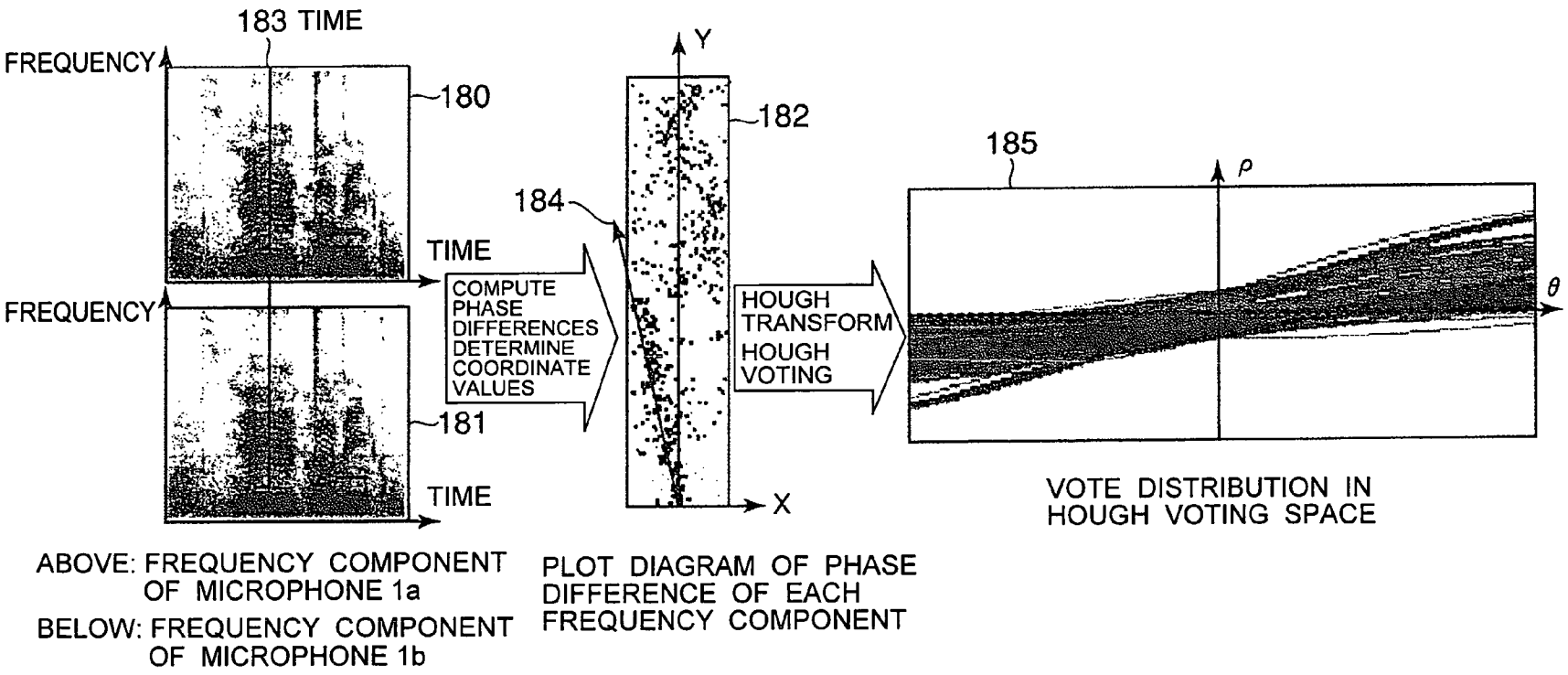
FIG. 17 is a view presenting a diagram showing frequency components generated from actual sounds, a phase difference plot diagram, and a diagram showing Hough voting results.

FIG. 17 shows a power spectrum of frequency components when processing is performed using actual voices spoken by a single person positioned approximately 20 degrees left with respect to the front of a microphone pair under a room noise environment, a phase difference plot diagram for each frequency component obtained from five (afore-mentioned m=5) consecutive FFT results, and Hough voting results (a vote distribution) obtained from the same five FFT results. Processing heretofore is executed by the series of function blocks from the acoustic signal inputting unit 2 to the voting unit 303.

Amplitude data acquired by the microphone pair is converted by the frequency decomposing unit 3 into data of a power value and a phase value for each frequency component. In the diagram, reference numerals 180 and 181 are brightness displays (where the darker the display, the greater the value) of logarithms of power values of the respective frequency components, with the abscissa representing time. The diagram is a graph representation of lines along the lapse of time (rightward), where a single vertical line corresponds to a single FFT result. The upper diagram 180 represents the result of processing of signals from the microphone 1*a* while the lower diagram 181 represents the result of processing of signals from the microphone 1*b*. A large number of frequency components are detected in both diagrams. Based on the results of frequency decomposition, a phase difference for each frequency component is computed by the phase difference computing unit 301, and (x, y) coordinate values thereof are computed by the coordinate value determining unit 302. In FIG. 17, reference numeral 182 denotes a diagram that plots phase differences obtained through five consecutive FFTs commencing at a given time instant 183. In the diagram, while a point group distribution along a straight line 184 that tilts towards the left from the origin may be observed, the distribution is not arranged on the straight line 184 in an orderly manner, and many points exist that are removed from the straight line 184. The voting unit 303 votes the respective points distributed as shown onto a Hough voting space to form a vote distribution 185. Incidentally, reference numeral 185 shown in FIG. 17 is a vote distribution generated using the addition method 2.

(Constraint of $\rho=0$)

When signals from the microphones 1*a* and 1*b* are A/D converted in-phase with each other by the acoustic signal inputting unit 2, the straight line to be detected inevitably passes through $\rho=0$ or, in other words, the XY coordinate origin. Therefore, the issue of sound source estimation boils down to an issue for retrieving a peak value from a vote distribution $S(\theta, 0)$ on the $\theta$ axis where $\rho=0$ in the Hough voting space. A result of retrieving a peak value on the $\theta$ axis with respect to data exemplified in FIG. 17 is shown in FIG. 18.

In the diagram, reference numeral 190 denotes the same vote distribution as indicated by reference numeral 185 in FIG. 17. Reference numeral 192 in the diagram denotes a bar graph representation of the vote distribution $S(\theta, 0)$ on a $\theta$ axis 191 extracted as $H(\theta)$. Several peak locations (projecting portions) exist on the vote distribution $H(\theta)$. With respect to the vote distribution $H(\theta)$, the straight line detecting unit 304 (1) retains, when a count that is the same as a given location is continuously retrieved from the left and right of that location, a location where only less votes eventually appear. As a result, a lobe on the vote distribution $H(\theta)$ is extracted. However, since the lobe contains flat peaks, successive peak values exist in the lobe. Therefore, the straight line detecting unit 304 (2) retains only a central position of the lobe as the peak position through a thinning process, as indicated by reference numeral 193 in the diagram. Finally, (3) only peak positions where votes equal or exceed a predetermined threshold are detected as a straight line. Through this arrangement, $\theta$ of a straight line that has acquired sufficient votes may be accurately determined. In the example shown in the diagram, among peak positions 194, 195 and 196 detected in (2) described above, reference numeral 194 denotes a central position (in the event there exists an even number of consecutive peak positions, the right takes precedence) retained by the thinning process performed on the flat lobe. In addition, reference numeral 196 denotes the sole straight line detected as a straight line that had acquired votes equal to or exceeding the threshold. A straight line defined by $\theta$ obtained by the peak position 196 and $\rho$ (=0) is represented by reference numeral 197 in the diagram. Incidentally, for a thinning process algorithm, an one-dimensionalization of the "Tamura method" described in pages 89 to 92 in Reference Document 2 that has been introduced in the description of Hough transform may be used. Upon detection of one or a plurality of peak positions (central positions that have acquired votes equal to or greater than the threshold) in this manner, the straight line detecting unit 304 places the peak positions in a descending order of acquired votes and outputs $\theta$ and $\rho$ values for each peak position.

(Definition of a Straight line Group in Consideration of Phase Difference Recurrence)

Figure 18:
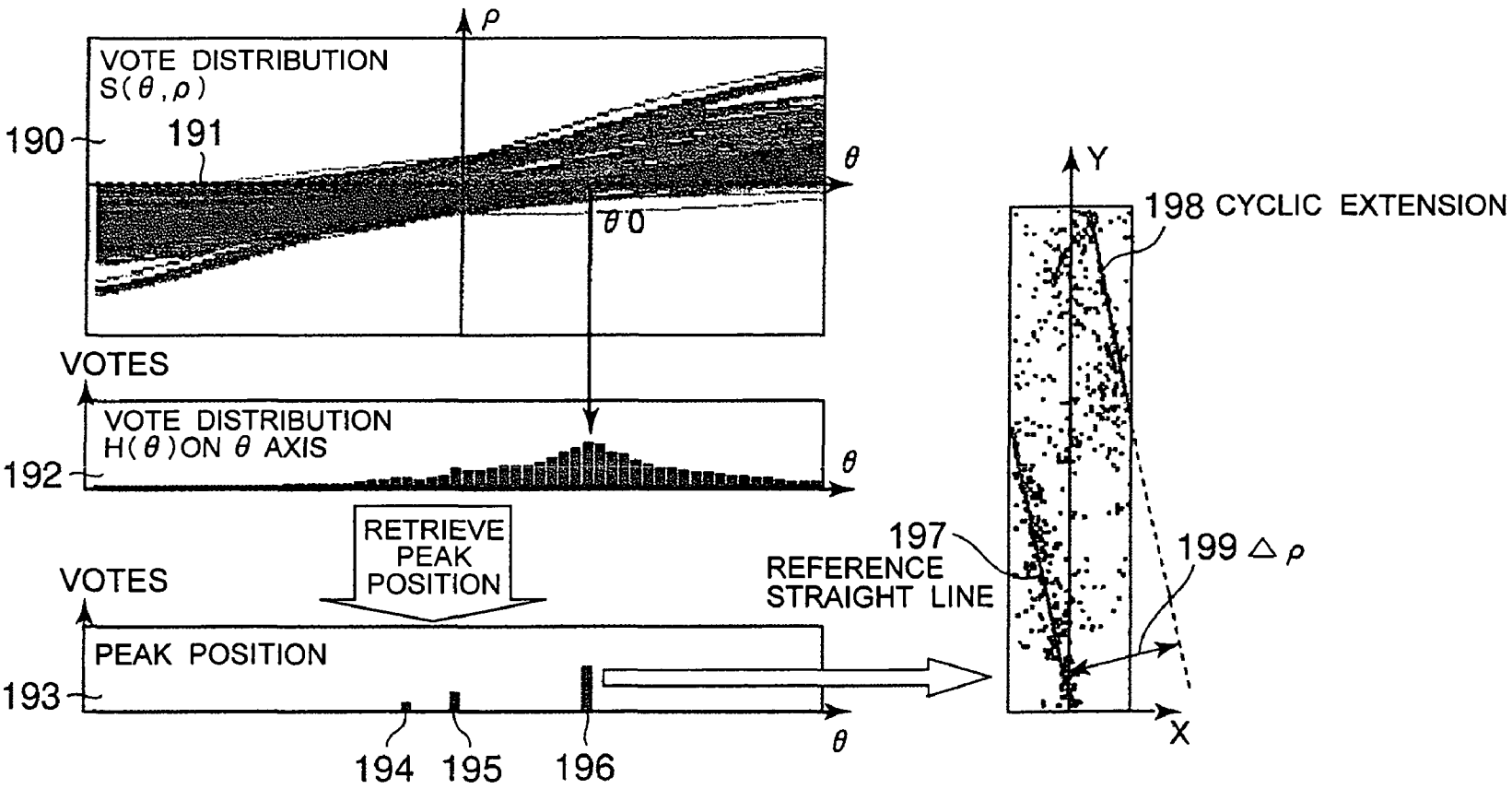
FIG. 18 is a diagram showing peak positions and straight lines obtained from actual Hough voting results.

The straight line 197 exemplified in FIG. 18 is a straight line passing through an XY coordinate origin defined by the peak position 196 of ($\theta$0,0). However, in actuality, due to the circularity of phase differences, a straight line 198 that is a parallel displacement of the straight line 197 in FIG. 18 by $\Delta\rho$ (reference numeral 199 in the diagram) and which recurs from the opposite side of the X axis is also a straight line that indicates the same arrival time difference as the straight line 197. A straight line such as the straight line 198 that is an extension of the straight line 197 and in which a portion protruding from the range of "X" recurs from the opposite side shall be referred to as a "cyclic extension" of the straight line 197, while the straight line 197 used as reference will be referred to as a "reference straight line". A further slope of the reference straight line 197 would result in a greater number of cyclic extensions. Assuming that a coefficient "a" is an integer equal to or greater than 0, all straight lines sharing the same arrival time difference will form a group ($\theta$0, a$\Delta\rho$) of straight lines that are parallel displacements of the reference straight line 197, defined by ($\theta$0, 0), by $\Delta\rho$. In addition, by generalizing $\rho$ that serves as an origin as $\rho=\rho$0 by removing the constraint of $\rho=0$, the straight line group may now be expressed as ($\theta$0, a$\Delta\rho+\rho$0). In this case, $\Delta\rho$ is a signed value defined by the formula shown in FIG. 19 as a function $\Delta\rho$ ($\theta$) of the slope $\theta$ of the straight line.

Figure 19:
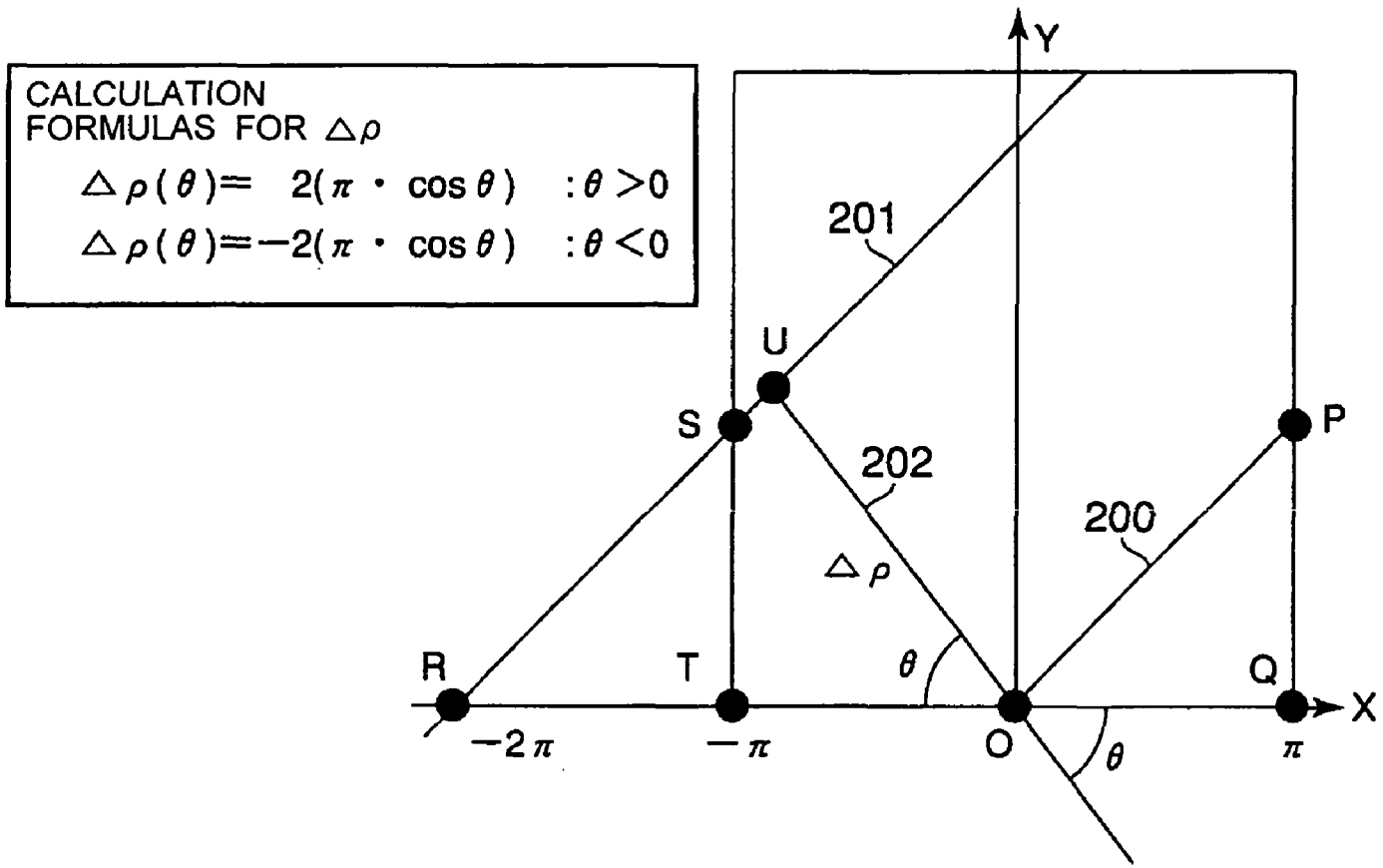
FIG. 19 is a diagram showing a relationship between θ and Δρ.

Reference numeral 200 in FIG. 19 denotes a reference straight line defined by ($\theta$, 0). In this case, in accordance with the definition, while $\theta$ will take a negative value since the reference straight line is tilted towards the right, $\theta$ will be treated as an absolute value thereof in FIG. 19. Reference numeral 201 in FIG. 19 denotes a cyclic extension of the reference straight line 200, and intersects the X axis at a point "R". In addition, the interval between the reference straight line 200 and the cyclic extension 201 is $\Delta\rho$ as indicated by an auxiliary line 202. The auxiliary line 202 perpendicularly intersects the reference straight line 200 at a point "O", and perpendicularly intersects the cyclic extension 201 at a point "U". In this case, in accordance with the definition, while $\theta$ will take a negative value since the reference straight line is tilted towards the right, $\theta$ will be treated as an absolute value thereof in FIG. 19. In FIG. 19, $\Delta$OQP is a right triangle in which the length of a side OQ is $\pi$, while ARTS is a congruent triangle thereof. Thus, the length of a side RT is also $\pi$, which means that the hypotenuse OR of $\Delta$OUR is $2\pi$. In this case, since $\Delta\rho$ is the length of a side OU, $\Delta\rho=2\pi\cos\theta$ is true. Furthermore, by considering the signs of $\theta$ and $\Delta\rho$, the formulas shown in FIG. 19 is derived.

(Detection of a Peak Position in Consideration of Phase Difference Recurrence)

As described above, due to the circularity of phase differences, a straight line representing a sound source should be treated not as a single straight line, but rather as a straight line group made up of a reference straight line and cyclic extensions thereof. This fact must be taken into consideration even when detecting peak positions from a vote distribution. Normally, as far as cases are concerned where a sound source is detected when a recurrence of phase differences does not occur or where a sound source is detected from the vicinity of the front of the microphone pairs where a recurrence, if any, is limited to a small scale, the above-described method involving retrieving peak positions solely based on voting values on $\rho=0$ (or $\rho=\rho$0) (in other words, voting values on the reference straight line) not only is sufficient from a performance perspective, but is also effective in reducing retrieval time and improving accuracy. However, when attempting to detect a sound source that exists in a wider range, it will be necessary to retrieve peak positions by adding up voting values of several locations that are mutually separated by intervals of $\Delta\rho$ with respect to a given $\theta$. The difference thereof will be described below.

Figure 20:
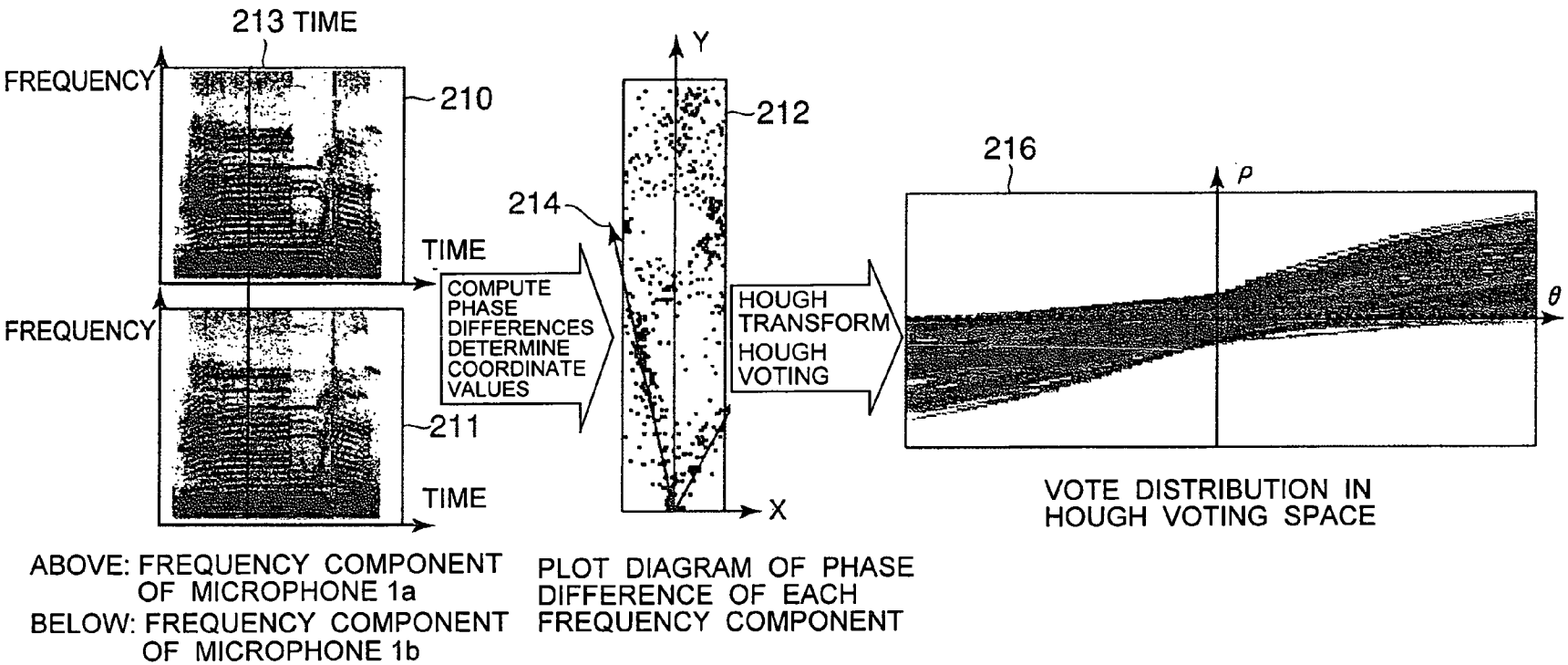
FIG. 20 presents a diagram showing frequency components during simultaneous speech, a phase difference plot diagram, and a diagram showing Hough voting results.

FIG. 20 shows a power spectrum of frequency components when processing is performed using actual voices spoken by two persons respectively positioned approximately 20 degrees left and approximately 45 degrees right with respect to the front of a microphone pair under a room noise environment, a phase difference plot diagram of each frequency component obtained from five (m=5) consecutive FFT results, and Hough voting results (a vote distribution) obtained from the same five FFT results.

Amplitude data acquired by the microphone pair is converted by the frequency decomposing unit 3 into data of a power value and a phase value for each frequency component. In FIG. 20, reference numerals 210 and 211 are brightness displays (where the darker the display, the greater the value) of logarithms of power values of the respective frequency components, where the ordinate represents frequency and the abscissa represents time. FIG. 20 is a graph representation of lines along the lapse of time (rightward), where a single vertical line corresponds to the results of a single FFT. The upper diagram 210 represents the result of processing of signals from the microphone 1*a* while the lower diagram 211 represents the result of processing of signals from the microphone 1*b*. A large number of frequency components are detected in both diagrams. Based on the results of frequency decomposition, a phase difference for each frequency component is computed by the phase difference computing unit 301, and an (x, y) coordinate thereof is computed by the coordinate value determining unit 302. In FIG. 20, reference numeral 212 denotes a diagram that plots phase differences obtained through five consecutive FFTs commencing at a given time instant 213. In FIG. 20, a point group distribution along a reference straight line 214 that tilts leftward from the origin and a point group distribution along a reference straight line 215 that tilts rightward therefrom are observed. The voting unit 303 votes the respective points distributed as shown onto a Hough voting space to form a vote distribution 216. Incidentally, reference numeral 216 shown in FIG. 20 is a vote distribution generated using the addition method 2.

Figure 21:
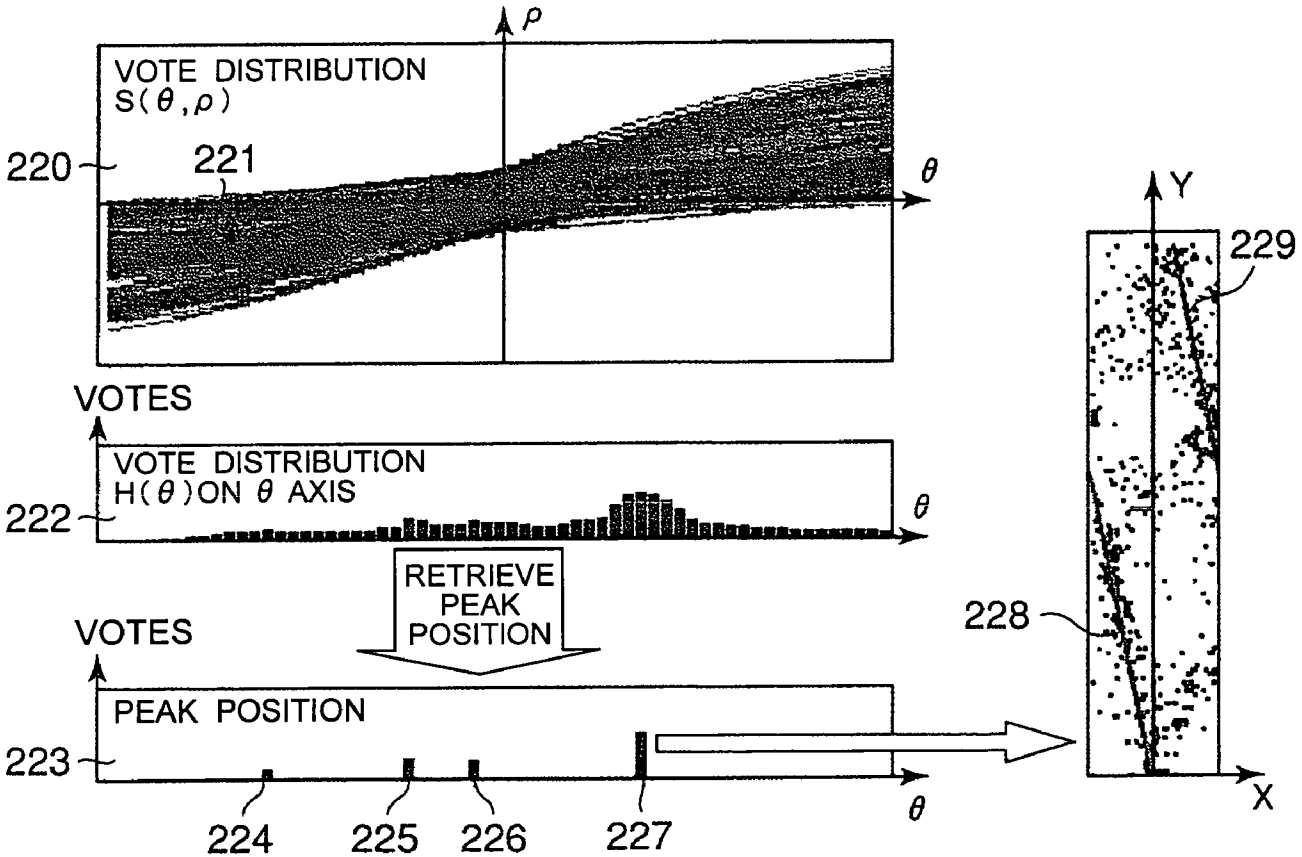
FIG. 21 is a diagram showing results of retrieval of peak positions using only voting values on the θ axis.

FIG. 21 is a diagram showing results of retrieval of peak positions using only voting values on the $\theta$ axis. In FIG. 21, reference numeral 220 denotes the same vote distribution as indicated by reference numeral 216 in FIG. 20. Reference numeral 222 in FIG. 21 denotes a bar graph representation of the vote distribution $S(\theta, 0)$ on the $\theta$ axis 221 extracted as $H(\theta)$. It may be seen that, while several peak locations (protruding portions) exist in the vote distribution $H(\theta)$, the locations share a characteristic in that the greater the absolute value of $\theta$, the smaller the number of votes. Four peak positions 224, 225, 226 and 227, shown in a diagram denoted by reference numeral 223 in FIG. 21, are detected from the vote distribution $H(\theta)$. Among the positions, only position 227 has acquired votes equal to or exceeding the threshold, and a single straight line group (a reference straight line 228 and a cyclic extension 229) is detected accordingly. While this straight line group includes sounds detected from approximately 20 degrees leftward from the front of the microphone pair, sounds from approximately 45 degrees rightward from the front of the microphone pair is not detected. For reference straight lines passing through the origin, the larger the angle, the fewer the number of frequency bands passed until exceeding the range of "X". Therefore, the width of the frequency band through which a reference straight line passes differs (an inequality will exist) according to $\theta$. In addition, since the constraint of $\rho=0$ results in competition on votes among only reference straight lines under such an unequal condition, the greater the angle of a straight line, the greater the disadvantage during voting. For this reason, sounds from approximately 45 degrees rightward cannot be detected.

Figure 22:
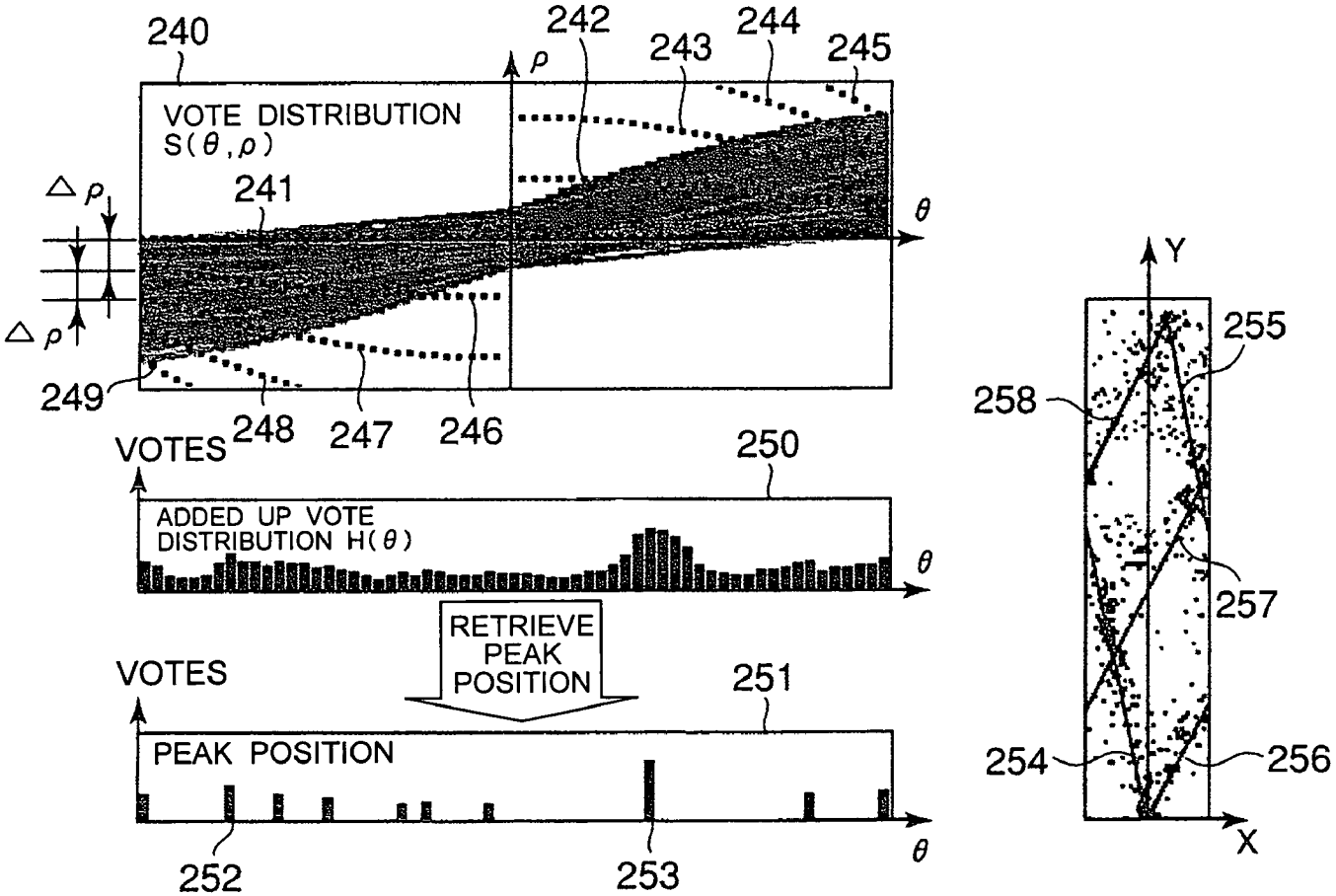
FIG. 22 is a diagram showing results of retrieval of peak positions by summing up voting values at several locations mutually separated by Δρ.

On the other hand, FIG. 22 is a diagram showing results of retrieval of peak positions by summing up voting values at several locations mutually separated by $\Delta\rho$. In FIG. 22, reference numeral 240 is a diagram showing positions of $\rho$ as dotted lines 242 to 249 when a straight line passing through the origin is parallel-shifted in intervals of $\Delta\rho$ on the vote distribution 216 shown in FIG. 20. In this case, a $\theta$ axis 241 and the dotted lines 242 to 245, as well as the $\theta$ axis 241 and the dotted lines 246 to 249 are respectively separated by equal intervals corresponding to natural number multiples of $\Delta\rho(\theta)$. Incidentally, a dotted line does not exist for $\theta=0$, where it is certain that a straight line will extend to the ceiling of the plot diagram without exceeding the range of "X".

A vote $H(\theta 0)$ of a given $\theta 0$ may be calculated as a summation of votes on the $\theta$ axis 241 and the dotted lines 242 to 249 as viewed vertically from the position $\theta=\theta 0$ or, in other words, as $H(\theta 0)=\Sigma\{S(\theta 0, a\Delta\rho(\theta 0))\}$. This operation corresponds to adding up the votes for a reference straight line at which $\theta=\theta 0$ is true and votes of cyclic extensions thereof. Reference numeral 250 in FIG. 22 is a bar graph representation of the vote distribution H(O). Unlike reference numeral 222 shown in FIG. 21, in this distribution, votes do not decrease even when the absolute value of $\theta$ increases. This is due to the fact that, by adding cyclic extensions to vote calculations, the same frequency band may now be used for all $\theta$. 10 peak positions as shown in a diagram 251 in FIG. 22 are detected from the vote distribution 250. Among the positions, peak positions 252 and 253 have acquired votes equal to or exceeding the threshold, and two straight line groups are detected, namely, a straight line group detecting sounds from approximately 20 degrees leftward from the front of the microphone pair (a reference straight line 254 and a cyclic extension 255 corresponding to the peak position 253) and a straight line group detecting sounds from approximately 45 degrees rightward from the front of the microphone pair (a reference straight line 256 and cyclic extensions 257 and 258 corresponding to the peak position 252). By adding up voting values for locations separated by intervals of $\Delta\rho$ to retrieve a peak position in this manner, straight lines having angles that range from small to large may be stably detected.

(Peak Position Detection in Consideration of a Case of Out-of-Phase: Generalization)

When signals from the microphones 1*a* and 1*b* are not A/D-converted in-phase with each other by the acoustic signal inputting unit 2, the straight line to be detected does not pass through $\rho=0$ or, in other words, the XY coordinate origin. In this case, it is necessary to remove the constraint of $\rho=0$ to retrieve a peak position.

When a reference straight line for which the constraint of $\rho=0$ has been removed is generalized and expressed as $(\theta 0, \rho 0)$, a straight line group thereof (reference straight line and cyclic extension) may be expressed as $(\theta 0, a\Delta\rho(\theta 0)+\rho 0)$, where $\Delta\rho(\theta 0)$ is a parallel displacement of cyclic extensions which is determined according to $\theta 0$. When a sound source arrives from a given direction, only a single most dominant corresponding straight line group exists at $\theta 0$. Using a value $\rho 0max$ of $\rho 0$ at which the vote $\Sigma\{S(\theta 0, a\Delta\rho(\theta 0)+\rho 0)\}$ takes a maximum value when varying the value of $\rho 0$, this straight line group may be expressed as $(\theta 0, a\Delta\rho(\theta 0)+\rho 0max)$. Then, by deeming the vote $H(\theta)$ at each 0 as a maximum voting value $\Sigma\{S(\theta 0, a\Delta\rho(\theta)+\rho 0max)\}$ at each 0, straight line detection may be performed to which is applied the same peak position detection algorithm as used when the constraint of $\rho=0$ is imposed.

(Shape Collating Unit 6)

Incidentally, the detected straight line groups are sound source candidates at each time instant independently estimated for each microphone pair. In this case, sounds emitted by a same sound source are respectively detected at the same time instant by the plurality of microphone pairs as straight line groups. Therefore, if it is possible to associate straight line groups derived from the same sound source at a plurality of microphone pairs, sound source information with higher reliability should be obtained. The shape collating unit 6 is means for performing association for such a purpose. In this case, information edited for each straight line group by the shape collating unit 6 shall be referred to as sound source candidate information.

Figure 23:
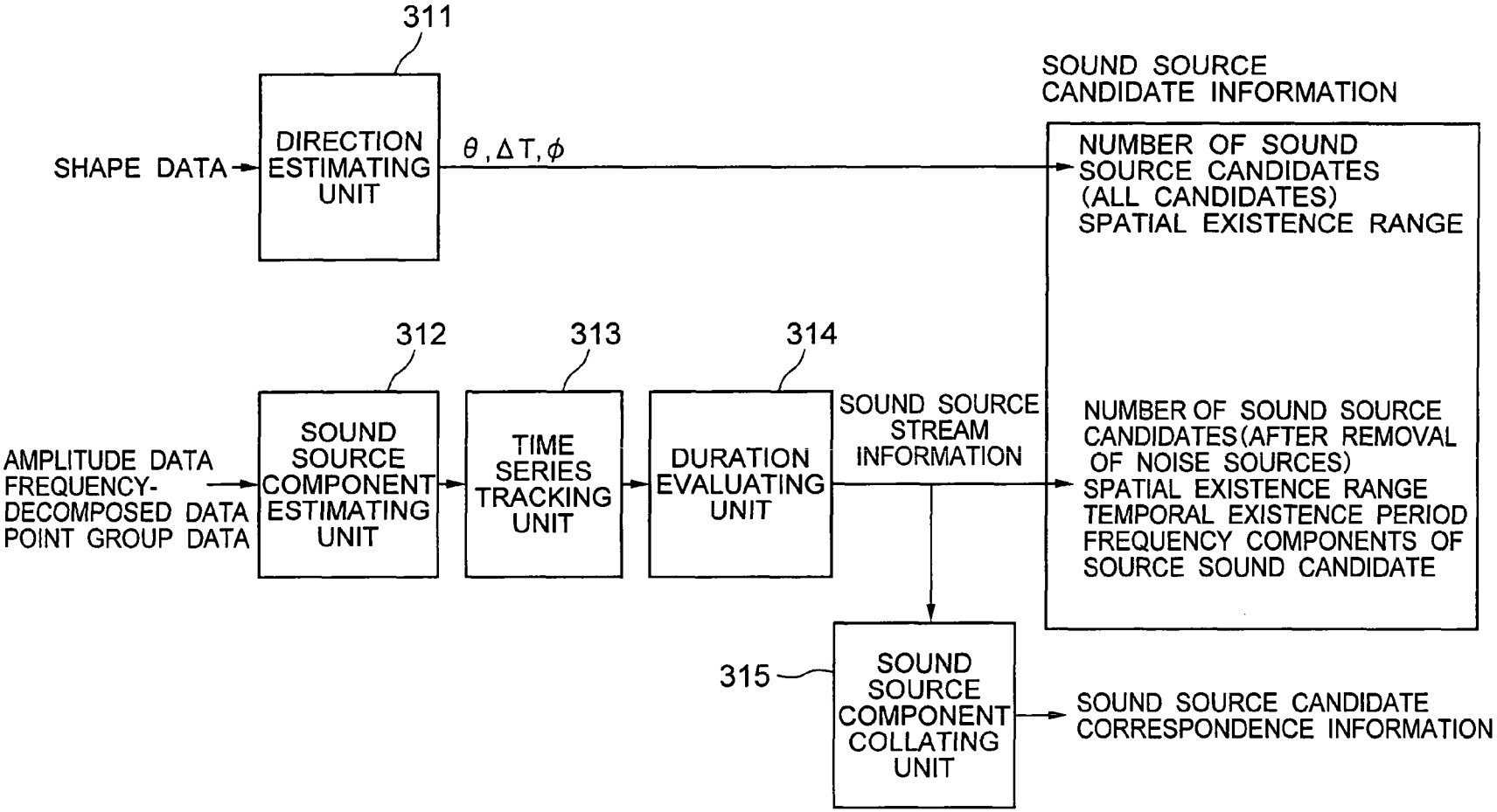
FIG. 23 is an internal configuration diagram of a shape collating unit.

As shown in FIG. 23, the shape collating unit 6 includes of a direction estimating unit 311, a sound source component estimating unit 312, a time series tracking unit 313, a duration evaluating unit 314, and a sound source component collation section 315.

(Direction Estimating Unit 311)

The direction estimating unit 311 is means for receiving the results of straight line detection performed by the straight line detecting unit 304 as described above or, in other words, the $\theta$ value for each straight line group, and calculating an existence range of a sound source corresponding to each straight line group. In this case, the number of detected straight line groups is deemed to be the number of sound source candidates. When the distance to a sound source is significantly greater than the baseline of a microphone pair, the existence range of the sound source forms a circular conical surface having a given angle with respect to the baseline of the microphone pair. A description thereof will be provided with reference to FIG. 24.

An arrival time difference $\Delta T$ between the microphones 1*a* and 1*b* may vary within a range of $\pm\Delta Tmax$. As shown in diagram (a) in FIG. 24, when sound is incident from the front, $\Delta T$ takes a value of 0, and a directional angle $\phi$ of the sound source takes a value of 0° when the front is used as reference. In addition, as shown in diagram (b) in FIG. 24, when sound is incident from directly right or, in other words, from the direction of the microphone 1*b*, $\Delta T$ equals $+\Delta Tmax$, and a directional angle $\phi$ of the sound source takes a value of +90° when the front is used as reference and when assuming that a clockwise rotation results in positive angles. Similarly, as shown in diagram (c) in FIG. 24, when sound is incident from directly left or, in other words, from the direction of the microphone 1*a*, $\Delta T$ equals $-\Delta Tmax$ while the directional angle $\phi$ is −90°. In this manner, $\Delta T$ is defined so as to take a positive value when sound is incident from the right and a negative value when sound is incident from the left.

Figure 24:
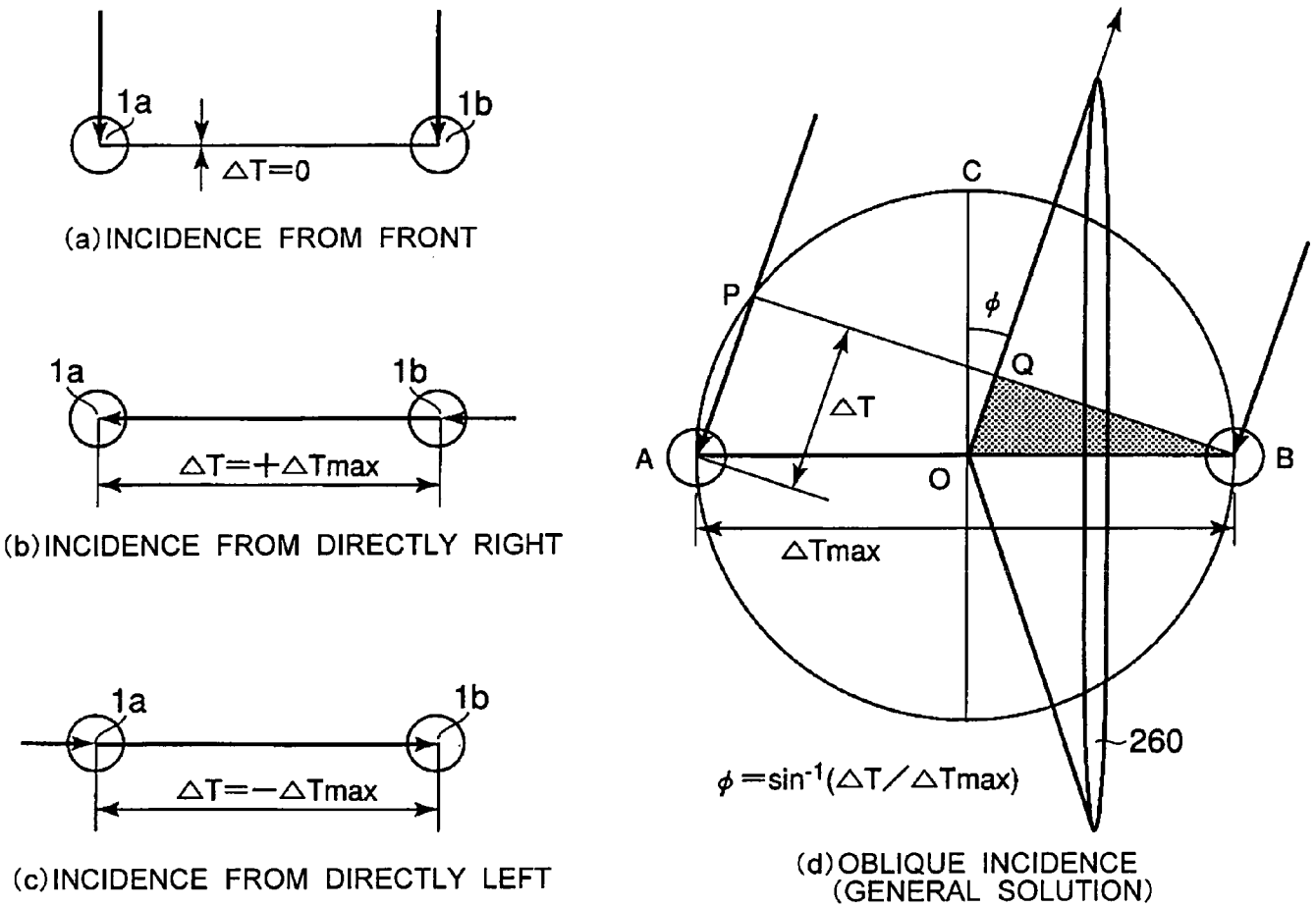
FIG. 24 is a diagram for explaining direction estimation.

Based on the above, a general condition such as represented by reference character (d) in FIG. 24 will now be considered. Assuming that the position of the microphone 1*a* is "A" and the position of the microphone 1*b* is "B", and that sound is incident from the direction of a line segment PA, $\Delta PAB$ will take the form of a right triangle with an apex P having a right angle. In this case, when the center of the microphones is "O" and a line segment OC constitutes a frontal direction of the microphone pair, a directional angle $\phi$ shall be defined as an angle that takes a positive value in a counter-clockwise direction when the OC direction has a directional angle of 0°. Since $\Delta QOB$ is similar to $\Delta PAB$, the absolute value of the directional angle $\phi$ is equivalent to $\angle OBQ$ or, in other words, $\angle ABP$, and a sign thereof is equal to that of $\Delta T$. In addition, $\angle ABP$ may be calculated as $\sin^{-1}$ of the ratio of PA to AB. In this case, by expressing the length of the line segment PA using $\Delta T$ corresponding thereto, the length or the line segment AB will be equivalent to $\Delta Tmax$. Therefore, the directional angle together with its sign may be calculated as $\phi=\sin^{-1}(\Delta T/\Delta Tmax)$. Furthermore, the existence range of the sound source may be estimated as a circular conical surface 260 that opens at $(90-\phi)°$, and which has point "O" as its summit and the baseline AB as its axis. The sound source exists somewhere on the circular conical surface 260.

Figure 25:
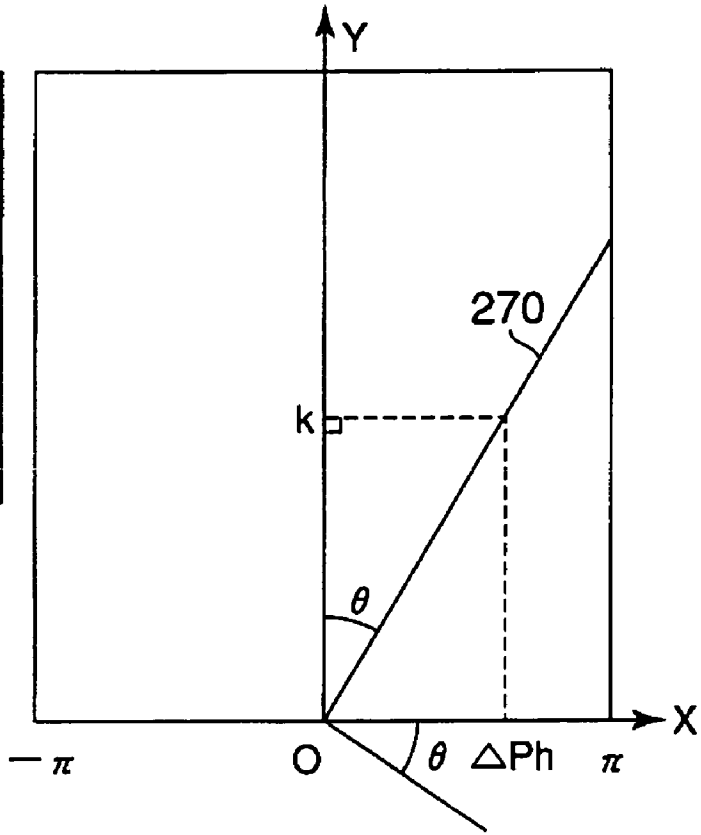
FIG. 25 is a diagram showing a relationship between θ and ΔT.

As shown in FIG. 25, $\Delta Tmax$ is a value obtained by dividing a distance between microphones "L" [m] by a sonic velocity Vs [m/sec]. In this case, sonic velocity Vs is known to be approximable as a function of ambient temperature "t" [° C.]. Assume now that a straight line 270 is detected by the straight line detecting unit 304 to have a slope of Hough, $\theta$. Since the straight line 270 is tilted towards the right, $\theta$ will take a negative value. When y=k (frequency fk), a phase difference $\Delta Ph$ may be obtained as a function of "k" and $\theta$ from $k\cdot\tan(-\theta)$. In this case, $\Delta T$ [sec] is a time obtained by multiplying a single cycle (1/fk) [sec] of the frequency fk by a ratio of the phase difference $\Delta Ph$ $(\theta, k)$ to $2\pi$. Since $\theta$ is a signed amount, $\Delta T$ will also be a signed amount. In other words, when sound is incident from the right (when phase difference $\Delta Ph$ takes a positive value) as shown in FIG. 24(*d*), $\theta$ will take a negative value. In addition, when sound is incident from the left (when phase difference $\Delta Ph$ takes a negative value) as shown in FIG. 24(*d*), $\theta$ will take a positive value. For this reason, the sign of $\theta$ is inversed. Incidentally, actual calculations need only be performed at k=1 (the frequency immediately above the direct current component k=0).

(Sound Source Estimating Unit 312)

The sound source estimating unit 312 is means for evaluating a distance between coordinate values (x, y) for each frequency component given by the coordinate value determining unit 302 and a straight line detected by the straight line detecting unit 304 in order to detect points (in other words, frequency components) located in the vicinity of the straight line as frequency components of a relevant straight line group (in other words, a sound source), and estimating frequency components for each sound source based on the detection results.

(Detection by Distance Threshold Method)

Figure 26:
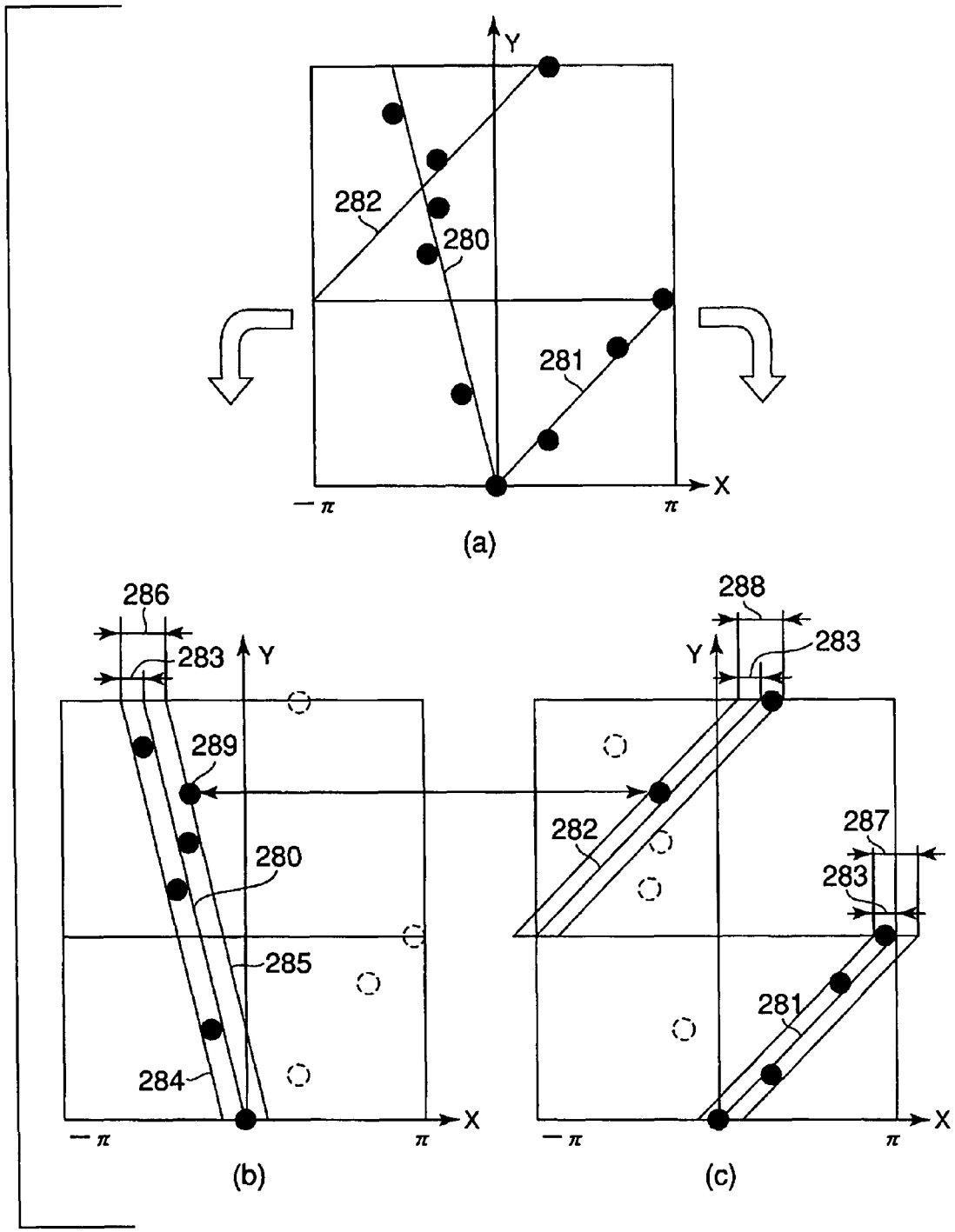
FIG. 26 is a diagram for explaining sound source component estimation (distance-threshold method) when a plurality of sound sources exist.

The principle of sound source component estimation in the event that a plurality of sound sources exist is schematically shown in FIG. 26. In FIG. 26, reference character (a) represents a plot diagram having the same frequency and phase difference as that shown in FIG. 9, which illustrates a case where two sound sources exist in different directions with respect to a microphone pair. In FIG. 26, reference numeral 280 in diagram (a) denotes one straight line group, while reference numerals 281 and 282 in diagram (a) denote another straight line group. Black dots in diagram (a) of FIG. 26 represents phase difference positions for respective frequency components.

As shown in diagram (b) in FIG. 26, frequency components of a source sound corresponding to the straight line group 280 are detected as frequency components (the black dots in the diagram) that are sandwiched between straight lines 284 and 285 that are respectively separated from the straight line 280 to the left and right thereof by a horizontal distance 283. The fact that a given frequency component is detected as a component of a given straight line shall be referred to as the frequency component being attributable (or belonging) to the straight line.

In a similar manner, as shown in diagram (c) in FIG. 26, frequency components of a source sound corresponding to the straight line groups 281 and 282 are detected as frequency components (the black dots in the diagram) that are located within a ranges 287 and 288 that are sandwiched between straight lines that are respectively separated from the straight lines 281 and 282 to the left and right thereof by a horizontal distance 283.

Incidentally, since the two points, namely, a frequency component 289 and the origin (direct current component) are included in both regions 286 and 288, the two points will be doubly detected as components of both sound sources (multiple attribution). As seen, a method in which: threshold processing is performed on a horizontal distance between a frequency component and a straight line; a frequency component existing within the threshold is selected for each straight line group (sound source); and a power and a phase thereof is deemed without modification to be a component of a relevant source sound shall be referred to as the "distance threshold method".

(Detection by Nearest Neighbor Method)

Figure 27:
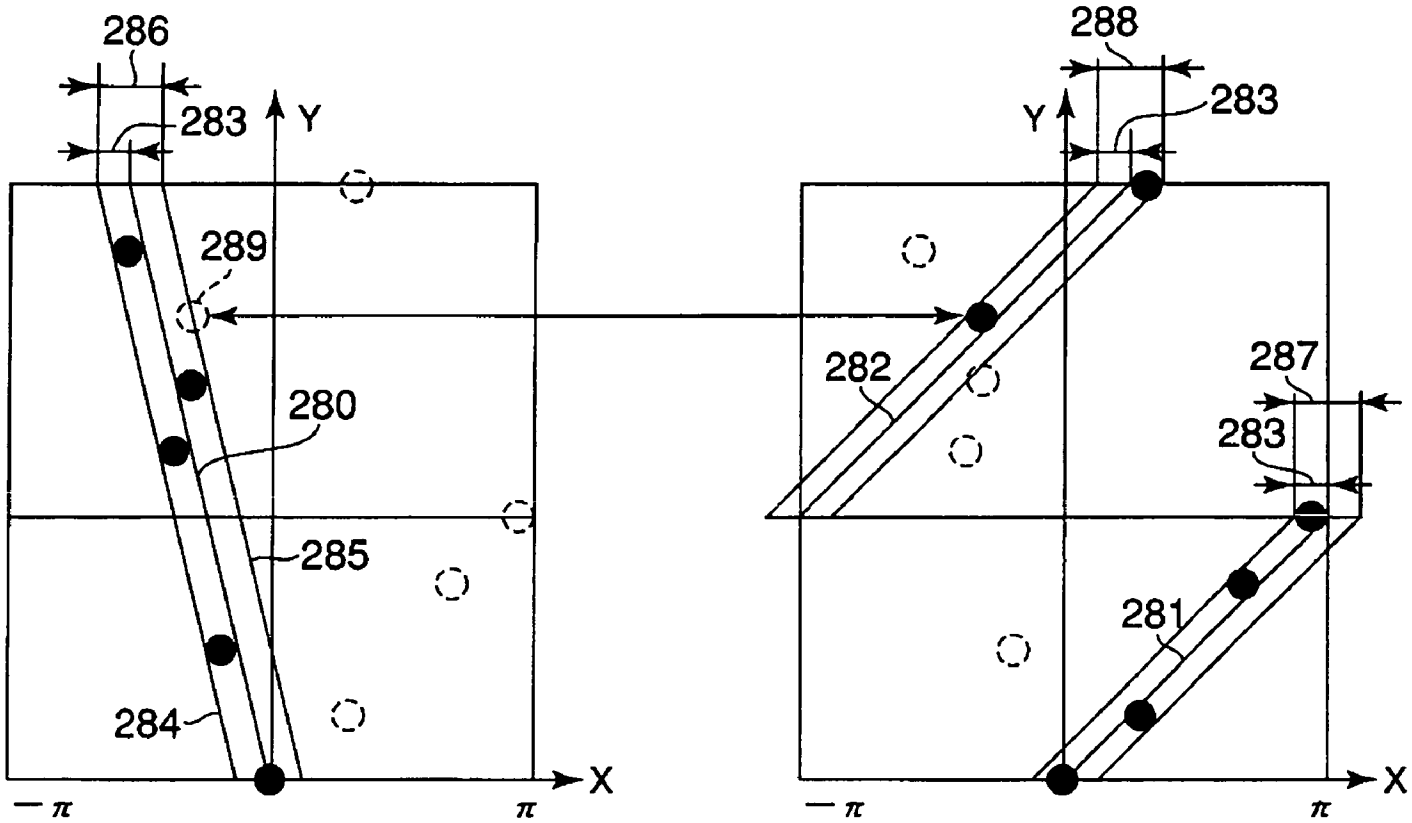
FIG. 27 is a diagram for explaining the nearest neighbor method.

FIG. 27 is a diagram showing a result of arranging the multiple-attributable frequency component 289 shown in FIG. 26 to attribute only to whichever straight line group that is the closest. By comparing the horizontal distances of the frequency component 289 with respect to the straight lines 280 and 282, it is found that the frequency component 289 is closest to the straight line 282. In this case, the frequency component 289 is within a region 288 that is in the vicinity of the straight line 282. As a result, the frequency component 289 will be detected as a component belonging to the straight line groups 281 and 282, as shown in diagram (b) in FIG. 26. As seen, a method in which: a straight line (sound source) with the shortest horizontal distance is selected for each frequency component; and when a horizontal distance is within a predetermined threshold, the power and the phase of a frequency components is deemed without modification as components of a relevant source sound shall be referred to as the "nearest neighbor method". Incidentally, it is assumed that an exception will be made for the direct current component (origin), which will be attributable to both straight line groups (sound sources).

(Detection by Distance Coefficient Method)

The two methods described above select only frequency components existing within a predetermined horizontal distance threshold with respect to straight lines including a straight line group, and deem the frequency components to be frequency components of a source sound corresponding to the straight line group without modifying the power and the phase difference of the frequency components. On the other hand, the "distance coefficient method" that will be next described is a method that calculates a nonnegative coefficient $\alpha$ that decreases monotonically as a horizontal distance "d" between a frequency component and a straight line increases, and multiplies the power of the frequency component with the coefficient $\alpha$ to enable components that are further away in terms of horizontal distance from the straight line to contribute to a source sound with weaker power.

Figure 28:
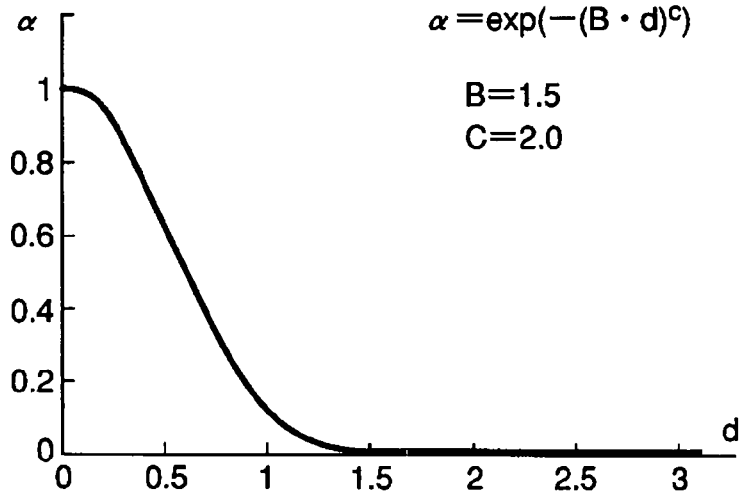
FIG. 28 is a diagram showing an example of a calculation formula for a and a graph thereof.

In this case, there is no need to perform threshold processing according to horizontal distance. With respect to a given straight line group, a horizontal distance (the horizontal distance to the nearest straight line within the straight line group) "d" is obtained for each horizontal component, whereby a value obtained by multiplying the power of a frequency component by a coefficient $\alpha$ determined based on the horizontal distance "d" is deemed to be the power of the frequency component for the straight line group. While the calculation formula of the nonnegative coefficient $\alpha$ that decreases monotonically as the horizontal distance "d" increases is arbitrary, a sigmoid function $\alpha=\exp(-(B\cdot d)^C)$, shown in FIG. 28, is presented as an example. In this case, as exemplified in FIG. 28, if "B" is a positive numerical value (1.5 in FIG. 28) and "C" is a numerical value that is larger than 1 (2.0 in FIG. 28), then $\alpha=1$ when $d=0$ and $\alpha\rightarrow 0$ when $d\rightarrow\infty$. When the rate of decrease of the nonnegative coefficient $\alpha$ is steep or, in other words, when "B" is large, since components separated from the straight line group have a higher likelihood of being removed, directionality towards the sound source direction will become more acute. Conversely, when the rate of decrease of the nonnegative coefficient $\alpha$ is gentle or, in other words, when "B" is small, directionality will become less acute.

(Handling of a Plurality of FFT Results)

As described above, the voting unit 303 is capable of both performing voting for every FFT and performing voting collectively on "m" number ($m\geqq 1$) of consecutive FFT results. Therefore, the function blocks of the straight line detecting unit 304 that processes Hough voting results operate by using the duration of an execution of a single Hough transform as a unit. In this case, when $m\geqq 2$ Hough votings are performed, FFT results for a plurality of time instants will be classified as components configuring the respective source sound, and it is possible that the same frequency component at different time instants will be attributed to different source sounds. In order to handle such cases, regardless of the value of "m", the coordinate value determining unit 302 adds to each frequency component (in other words, the black dots shown in FIG. 26) a time instant of commencement of a frame in which the frequency component is acquired as acquisition time instant information, making it possible to reference which frequency component of which time instant is attributable to which sound source. In other words, a source sound is separated and extracted as time series data of the frequency component.

(Power Retaining Option)

Incidentally, with each method described above, for frequency components (only the direct current component in the case of the nearest neighbor method, and all frequency components in the case of the distance coefficient method) belonging to a plurality ("N" number) of straight line groups (sound sources), it is also possible to normalize and divide by "N" the power of a frequency component of a same time instant which is allocated to each sound source such that a summation of the power is equivalent to a power value Po (fk) of the time instant prior to allocation. Through this arrangement, it is possible to maintain total power over an entire sound source for respective frequency components at the same time instant to be equivalent to input thereto. This arrangement shall be referred to as the "power retaining option". As allocation methods, the following two concepts exist.

(1) Equal division by "N" (applicable to the distance threshold method and the nearest neighbor method)

(2) Allocation according to distance to each straight line group (applicable to the distance threshold method and the distance coefficient method)

(1) is an allocation method that achieves automatic normalization through equal division into "N" equal parts, and is applicable to the distance threshold method and the nearest neighbor method which determine allocation regardless of distance.

(2) is an allocation method that retains total power by determining a coefficient in the same manner as the distance coefficient method and subsequently performing normalization such that the summation of power takes a value of 1. This method is applicable to the distance threshold method and the distance coefficient method in which multiple attribution occurs at locations other than the origin.

Incidentally, the sound source component estimating unit 312 may be set to perform any of the distance threshold method, the nearest neighbor method and the distance coefficient method. In addition, the above-described power retaining option may be selected for the distance threshold method and the nearest neighbor method.

(Time Series Tracking Unit 313)

As described above, a straight line group is obtained by the straight line detecting unit 304 for each Hough voting performed by the voting unit 303. Hough voting is collectively performed for "m" number ($m \geqq 1$) of consecutive FFT results. As a result, straight line groups will be obtained as a time series using "m" number of frames' worth of time as a cycle (to be referred to as a "shape detection cycle"). In addition, since $\theta$ of a straight line group has a one-to-one correspondence to the sound source direction $\phi$ calculated by the direction estimating unit 311, a locus of $\theta$ (or $\phi$) on the temporal axis corresponding to a stable sound source should be continuous. On the other hand, there are cases in which straight line groups detected by the straight line detecting unit 304 include straight line groups (which shall be referred to as "noise straight line groups") corresponding to background noise according to setting conditions of thresholds. However, it may be anticipated that a locus of $\theta$ (or $\phi$) of such a noise straight line group on the temporal axis is either discontinuous or is continuous but short.

Figure 29:
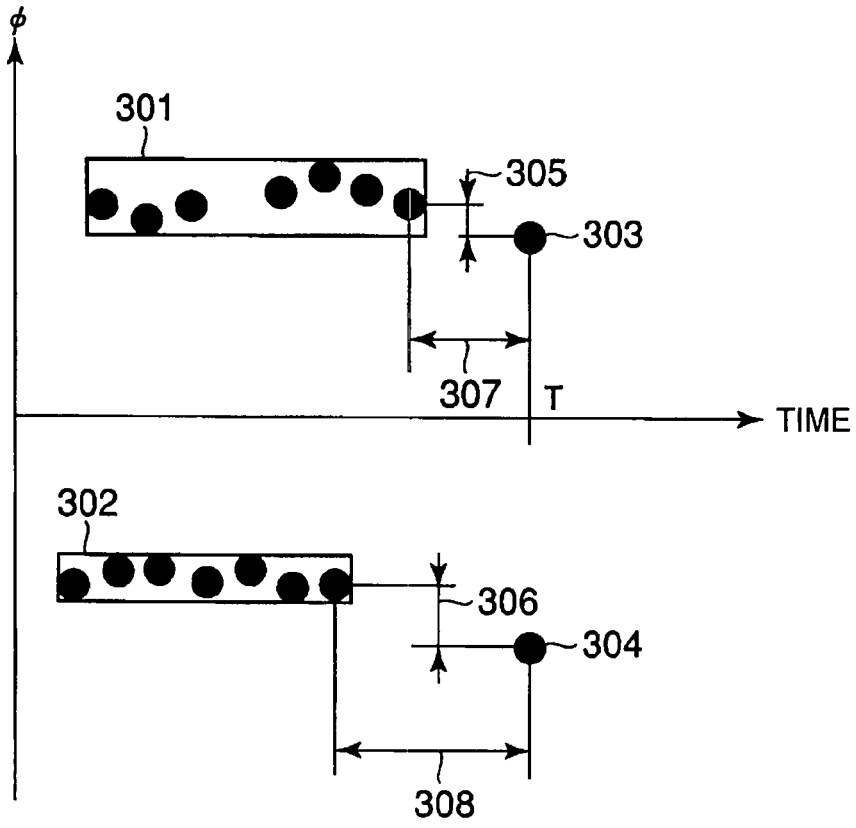
FIG. 29 is a diagram for explaining tracking of ϕ on a temporal axis.

The time series tracking unit 313 is means for obtaining a locus of $\phi$ on the temporal axis which is calculated for each shape detection cycle by dividing $\phi$ into continuous groups on the temporal axis. Methods for grouping will be described below with reference to FIG. 29.

(1) A locus data buffer is prepared. This locus data buffer is an array of locus data. A single unit of locus data Kd is capable of retaining its start time instant Ts, its end time instant Te, an array (straight line group list) of straight line group data Ld including the locus, and a label number Ln. A single unit of straight line group data Ld is a group of data including: a $\theta$ value and a $\rho$ value (obtained by the straight line detecting unit 304) of a single straight line group including the locus; a $\phi$ value (obtained by the direction estimating unit 311) representing a sound source direction corresponding to this straight line group; frequency components (obtained by the sound source component estimating unit 312) corresponding to this straight line group; and the time instant at which these are acquired. Incidentally, a locus data buffer is initially empty. In addition, a new label number is prepared as a parameter for issuing label numbers, and the initial value thereof is set to 0.

(2) At a given time instant "T", for each newly obtained $\phi$ (hereinafter referred to as +n, and in FIG. 29, it is assumed that two $\phi$ represented by black dots 303 and 304 are obtained), straight line group data Ld (the black dot arranged in a rectangle shown in FIG. 29) in locus data Kd (rectangles 301 and 302 in FIG. 29) retained in the locus data buffer is referenced, and locus data is detected which includes an Ld in which a difference between a $\phi$ value thereof and $\phi n$ is within a predetermined angle threshold $\Delta\phi$ and a difference of acquisition time instants thereof (reference numerals 307 and 308 in FIG. 29) is within a predetermined time threshold $\Delta t$. As a result, assume that locus data 301 has been detected for the black dot 303, but for the black dot 304, even the nearest locus data 302 was unable to fulfill the above-mentioned conditions.

(3) Like the black dot 303, when locus data fulfilling the conditions of (2) is discovered, $\phi n$ is deemed to have the same locus as the discovered locus, $\phi n$, corresponding $\theta$ and $\rho$ values, frequency component and a current time instant "T" are added to the straight line group list as new straight line group data, and the current time instant "T" is deemed to be the new end time instant Te of the locus. At this point, if a plurality of loci are found, all the loci are considered to form the same locus, and the loci are integrated into locus data having the smallest label number, whereby all other locus data is deleted from the locus data list. The start time instant Ts of the integrated locus data is the earliest start time instant among the respective locus data prior to integration, the end time instant Te of the integrated locus data is the latest end time instant among the respective locus data prior to integration, and the straight line group list is a union of straight line group lists of respective locus data prior to integration. As a result, the black dot 303 is added to the locus data 301.

(4) As in the case of the black dot 304, the failure to find locus data satisfying the conditions provided in (2) will mark the start of a new locus, whereby new locus data is created in an available portion of the locus data buffer, a start time instant Ts and an end time instant Te are both set to the current time instant "T", $\phi n$, corresponding $\theta$ and $\rho$ values, frequency component and the current time instant "T" are added to the straight line group list as the first straight line group data therein, the value of the new label number is given as the label number Ln of the locus, and the new label number is incremented by 1. Incidentally, in the event that the new label number has reached a predetermined maximum value, the new label number is reset to 0. As a result, the black dot 304 is registered into the locus data buffer as a new locus data.

(5) Among locus data retained in the locus data buffer, if there is locus data for which the above-mentioned predetermined time $\Delta t$ has lapsed from the last update (in other words, the end time instant Te of the locus data) to the present time instant "T", it is assumed that a new $\phi n$ to be added had not been found for the locus or, in other words, tracking has concluded for the locus. After outputting the locus data to the next-stage duration evaluating unit 314, the locus data is deleted from the locus data buffer. In the example shown in FIG. 29, the locus data 302 corresponds to this locus data.

(Duration Evaluating Unit 314)

The duration evaluating unit 314 calculates a duration of loci from the start time instant and the end time instant of locus data, for which tracking has been concluded, which is outputted from the time series tracking unit 313, certifies locus data for which the duration has exceeded a predetermined threshold as locus data based on a source sound, and certifies others as locus data based on noise. Locus data based on source sound shall now be referred to as sound source stream information. Sound source stream information includes a start time instant Ts and an end time instant Te of the source sound, and locus data that is a time series of $\theta$ and $\rho$ and $\phi$ representing sound source direction. Incidentally, although the number of straight line groups detected by the shape detecting unit 5 provides a number of sound sources, this number also includes noise sources. The number of sound source stream information determined by the duration evaluating unit 314 provides a number of reliable sound sources from which those based on noise have been removed.

(Sound Source Component Collating Unit 315)

The sound source component collating unit 315 generates sound source candidate correspondence information by associating sound source stream information that is respectively obtained via the time series tracking unit 313 and the duration evaluating unit 314 with respect to different microphone pairs with other sound source stream information derived from the same sound source. Sound emitted at the same time instant from the same sound source should have similar frequency components. Therefore, based on sound source components of respective time instants for each straight line group estimated by the sound source component estimating unit 312, patterns of frequency components at same time instants between sound source streams are collated to calculate a degree of similarity, and sound source streams having a frequency component pattern that has acquired a maximum degree of similarity that equals or exceeds a predetermined threshold are associated with each other. In this case, while it is possible to perform pattern collation across the entire sound source stream, a more effective approach would involve collating the frequency component patterns of several time instants in a duration in which sound source streams to be collated coexist and retrieving those for which a total degree of similarity or an average degree of similarity equals or exceeds a predetermined threshold and takes a maximum value. By using time instants at which the powers of both streams to be collated equal or exceed a predetermined threshold as the several time instants to be collated, a further improvement in the accuracy of collation may be expected.

Incidentally, it is assumed that the respective function blocks of the shape collating unit 6 are capable of exchanging information among each other, if necessary, by means of wire connection not shown in FIG. 23.

(Sound Source Information Generating Unit 7)

Figure 30:
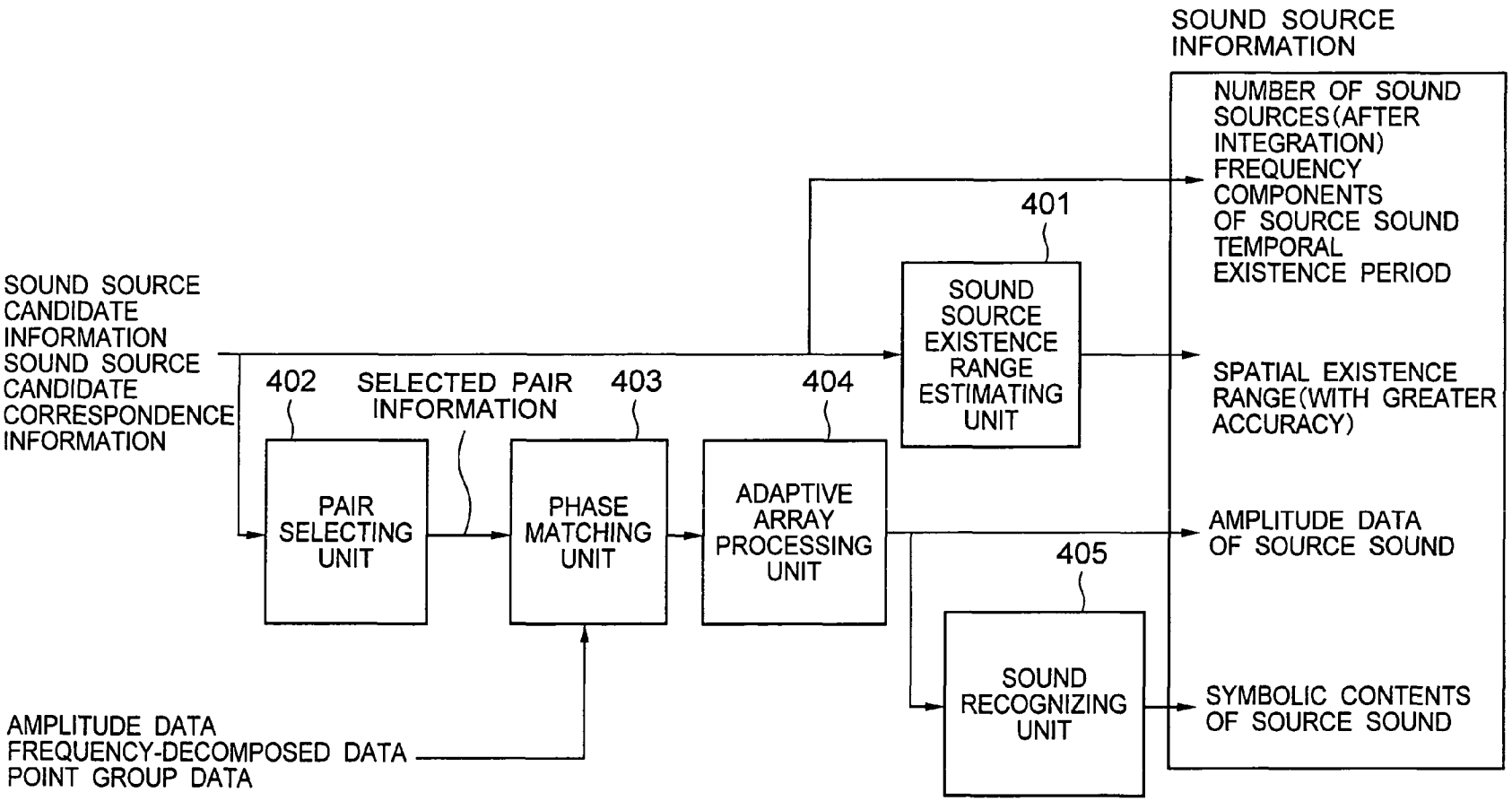
FIG. 30 is an internal configuration diagram of a sound source information generating unit.

As shown in FIG. 30, the sound source information generating unit 7 includes a sound source existence range estimating unit 401, a pair selecting unit 402, a phase matching unit 403, an adaptive array processing unit 404, and a sound identifying unit 405. The sound source information generating unit 7 is means for generating information related to a sound source that is more accurate and reliable from sound source candidate information that has been associated by the shape collating unit 6.

(Sound Source Existence Range Estimating Unit 401)

The sound source existence range estimating unit 401 is means for computing a spatial existence range of a sound source based on sound source candidate correspondence information generated by the shape collating unit 6. There are two computation methods as presented below, which may be switched by means of parameters.

(Computation method 1) Assume sound source directions respectively indicated by sound source stream information associated as derived from the same sound source form a circular conical surface (diagram "d" in FIG. 21) having a midpoint of a microphone pair that has detected the respective sound source streams as its apex, and calculate predetermined vicinities of curves or points respectively obtained from all associated sound source streams at which the circular conical surface intersects as a spatial existence range of a sound source.

(Computation method 2) Calculate sound source directions respectively indicated by sound source stream information associated as derived from the same sound source as a spatial existence range of a sound source by computing points in space which completely fill the sound source directions with least square errors. In this case, by preparing a table of calculations of angles with respect to each microphone pair for discrete points on a concentrical spherical surface having the origin of the apparatus as its center, a point is retrieved from the table where the square sum of the error between an angle and the afore-mentioned sound source direction is minimum.

(Pair Selecting Unit 402)

The pair selecting unit 402 is means for selecting a most suitable pair for separation and extraction of source sounds based on sound source candidate correspondence information generated by the shape collating unit 6. There are two selection methods as presented below, which may be switched by means of parameters.

(Selection method 1) Compare sound source directions respectively indicated by sound source stream information associated as derived from the same sound source, and selecting a microphone pair that has detected a sound source stream that is nearest to the front. As a result, the microphone pair that captures source sound most squarely from the front will be used for source sound extraction.

(Selection method 2) Assume sound source directions respectively indicated by sound source stream information associated as derived from the same sound source form a circular conical surface (diagram "d" in FIG. 24) having a midpoint of a microphone pair that has detected the respective sound source streams as its apex, and selecting a microphone pair that has detected a sound source stream from which other sound sources are furthest from the circular conical surface. As a result, a microphone pair that is least affected by other sound sources will be used for source sound extraction.

(Phase Matching Unit 403)

The phase matching unit 403 obtains a temporal transition of a sound source direction $\phi$ of a stream from sound source stream information selected by the pair selecting unit 402, and calculates an intermediate value $\phi mid=(\phi max+\phi min)/2$ from a maximum value $\phi max$ and a minimum value $\phi min$ of $\phi$ to obtain a width $\phi w=\phi max-\phi mid$. Then, time series data of two pieces of frequency-decomposed data "a" and "b" which formed a basis of the sound source information is extracted from a time instant which precedes the start time instant Ts of the stream by a predetermined time up to a time instant at which a predetermined time has lapsed from the end time instant Te, whereby phase-matching is performed through correction so as to cancel out an arrival time difference that is inversely calculated by the intermediate value $\phi mid$.

Alternatively, assuming that a sound source direction $\phi$ of each time instant obtained from the direction estimating unit 311 may be expressed as $\phi mid$, phases of the time sequence data of the two pieces of frequency-decomposed data "a" and "b" may be constantly matched. Whether sound source stream information or $\phi$ of each time instant will be referenced is determined according to operation modes. Such operation modes may be set and changed as parameters.

(Adaptive Array Processing Unit 404)

The applicable array processing unit 404 separates and extracts source sound (time series data of a frequency component) of a stream at high accuracy by applying adaptive array processing in which central directionality is pointed to front 0° and a value obtained by adding a predetermined margin to $\pm\phi w$ is used as a tracking range to time series data of two pieces of extracted and phase-matched frequency-decomposed data "a" and "b". Incidentally, for adaptive array processing, as disclosed in Reference Document 3: Amada, Tadashi et al., "Microphone Array Technique for Speech Recognition", Toshiba Review 2004, Vol. 59, No. 9, 2004, a method that clearly separates and extracts sound in a set directional range may be used by employing two, primary and secondary, "Griffith-Jim generalized sidelobe cancellers" that are known in their own right as a beamformer configuration method.

Normally, adaptive array processing is used to accommodate only sounds from a direction of a preset tracking range. Therefore, the reception of sounds from all directions necessitates the preparation of a large number of adaptive arrays respectively set to different tracking ranges. On the other hand, according to the apparatus of the present embodiment, a number and directions of sound sources are first actually obtained, enabling activation of only a number of adaptive arrays equal in number to the sound sources and setting tracking ranges thereof to a predetermined narrow range corresponding to the directions of sound sources. Therefore, separation and extraction of sound may be performed with high accuracy and quality.

Additionally, in this case, by matching the phases of time sequence data of the two pieces of frequency-decomposed data "a" and "b" in advance, sound from all directions may be processed by merely setting the tracking range of adaptive array processing to the vicinity of the front.

(Sound Recognizing Unit 405)

The sound recognizing unit 405 analyzes and collates time series data of source sound frequency components extracted by the adaptive array processing unit 404 in order to extract signals (strings) representing symbolic contents of a relevant stream or, in other words, linguistic meanings, a sound source type or speaker identification thereof.

(Outputting Unit 8)

The outputting unit 8 is means for either outputting as sound source candidate information obtained by the shape collating unit 6, information including at least one of: a number of sound source candidates obtained as a number of straight line groups by the shape detecting unit 5; a spatial existence range (an angle $\phi$ that determines a circular conical surface) of a sound source candidate that is a source of the acoustic signals and which is estimated by the direction estimating unit 311; a component configuration (time series data of power and phase for each frequency component) of sound emitted by the sound source candidate and which is estimated by the sound source component estimating unit 312; a number of sound source candidates (sound source streams) obtained by the time series tracking unit 313 and the duration evaluating unit 314, from which noise sources have been removed; and a temporal existence period of a sound emitted by the sound source candidates obtained by the time series tracking unit 313 and the duration evaluating unit 314, or outputting as sound source information generated by the sound source information generating unit 7, information including at least one of: a number of sound sources obtained as a number of straight line groups (sound source streams) associated by the shape collating unit 6; a more detailed spatial existence range (a crossover range of a circular conical surface or a table-referenced coordinate value); a separated sound (time series data of amplitude values) for each sound source obtained by the pair selecting unit 402, the phase matching unit 403 and the adaptive array unit 404; and symbolic contents of the source sound obtained by the sound recognizing unit 405.

(User Interface Unit 9)

The user interface unit 9 is means for: presenting a user with various setting contents necessary for the above described acoustic signal processing; accepting settings and input from the user; saving setting contents to an external storage device and reading out setting contents from the same; visualizing and presenting the user with various processing results and intermediate results such as (1) displaying frequency components for each microphone, (2) displaying phase difference (or time difference) plot diagrams (in other words, displaying two-dimensional data), (3) displaying various vote distributions, (4) displaying peak positions, (5) displaying straight line groups on plot diagrams, such as shown in FIGS. 17 and 19, (6) displaying frequency components attributable to a straight line group as shown in FIGS. 23 and 24, and (7) displaying locus data as shown in FIG. 26; and allowing the user to select desired data for visualization in greater detail. Such an arrangement enables the user to verify operations of the apparatus of the present embodiment and adjusting the same to ensure desired operations, and subsequently use the apparatus of the present embodiment in an adjusted state.

(Processing Flowchart)

Figure 31:
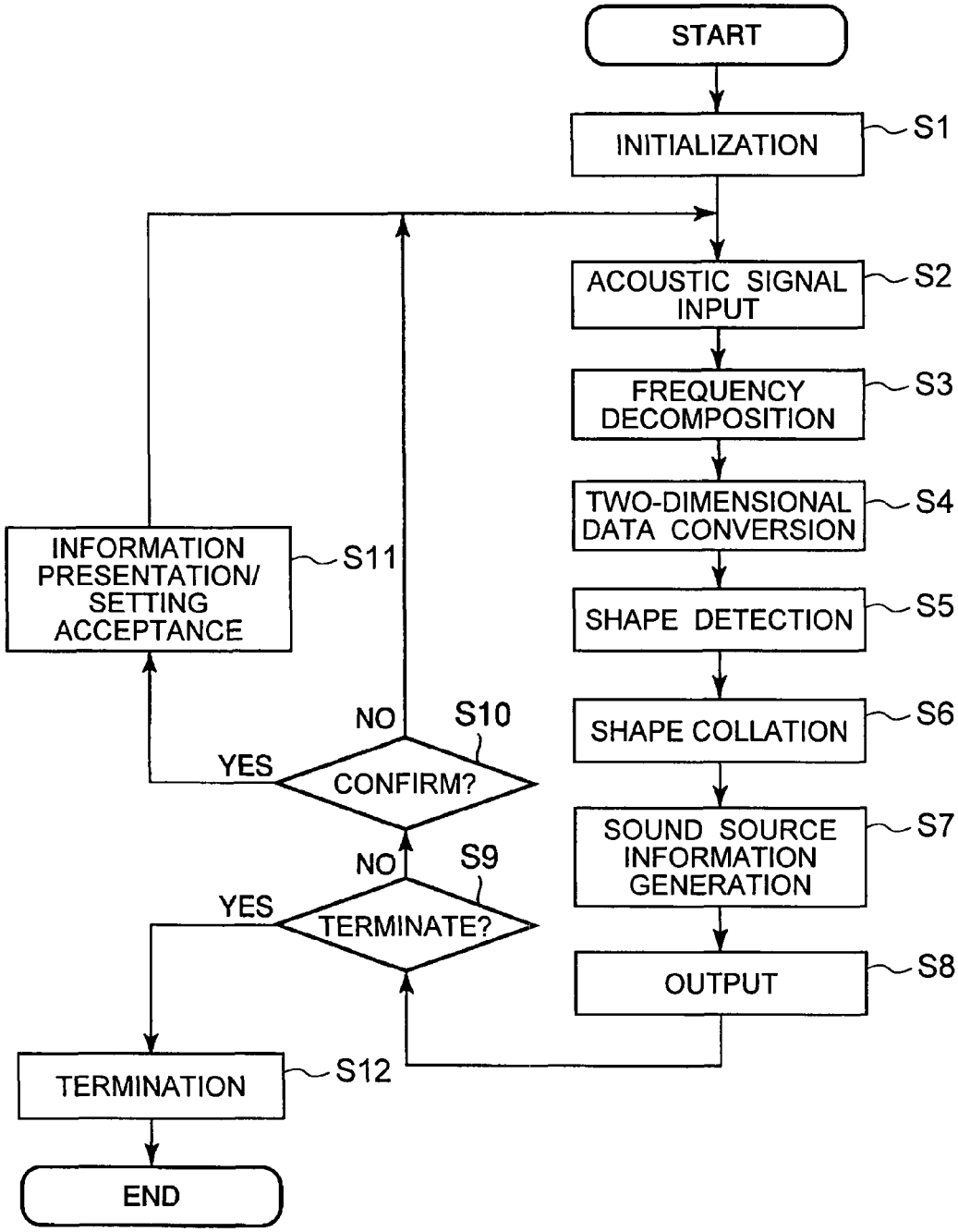
FIG. 31 is a diagram showing a flow of processing.

A flow of processing by the apparatus obtained by the present embodiment is shown in FIG. 31. The processing by the apparatus according to the present embodiment includes: an initialization step S1; an acoustic signal input step S2; a frequency decomposition step S3; a two-dimensional data conversion step S4; a shape detection step S5; a shape collation step S6; a sound source information generation step S7; an output step S8; a termination determination step S9; a confirmation determination step S10; an information presentation/setting acceptance step S11; and a termination step S12.

The initialization step S1 is a processing step for executing a portion of processing performed by the above-described user interface unit 8, and reads out various setting contents necessary for acoustic signal processing from an external storage device and initializes the apparatus to a predetermined setting state.

The acoustic signal input step S2 is a processing step for executing processing by the above-described acoustic signal inputting unit 2, and inputs two acoustic signals captured at two positions that are spatially different from each other.

The frequency decomposition step S3 is a processing step for executing processing performed by the above-described frequency decomposing unit 3, and respectively performs frequency decomposition on the acoustic signals inputted in the above acoustic signal input step S2 to compute at least a phase value (and if necessary, a power value as well) for each frequency.

The two-dimensional data conversion step S4 is a processing step for executing processing performed by the above-described two-dimensional data converting unit 4. The two-dimensional data conversion step S4 compares phase values for the respective frequencies of each inputted acoustic signal computed by the frequency decomposition step S3 to compute a phase difference value between the signals for each frequency, and converts the phase difference value of each frequency into (x, y) coordinate values that are uniquely determined by each frequency and a phase difference thereof and which is a point on an XY coordinate system having a frequency function as its Y axis and a phase difference value function as its X axis.

The shape detection step S5 is a processing step for executing the processing performed by the above-described shape detecting unit 5, and detects a predetermined shape from two-dimensional data from the two-dimensional data conversion step S4.

The shape collation step S6 is a processing step for executing processing performed by the above-described shape collating unit 6, and integrates shape information (sound source candidate correspondence information) obtained by a plurality of microphone pairs for a same sound source by deeming shapes detected in the shape detection step S5 to be sound source candidates and associating sound source candidates between different microphone pairs.

The sound source information generation step S7 is a processing step for executing processing performed by the above-described sound source information generating unit 7, and based on shape information (sound source candidate correspondence information) obtained by a plurality of microphone pairs and integrated by the shape collation step S6, generates sound source information that includes at least one of: a number of sound sources that are sources of the acoustic signals; a more detailed spatial existence range of each sound source; a component configuration of sound emitted by each sound source; a separated sound for each sound source; a temporal existence period of a sound emitted by each sound source; and symbolic contents of a sound emitted by each sound source.

The output step S8 is a processing step for executing processing performed by the above-described outputting unit 8, and outputs sound source candidate information generated in the shape collation step S6 or sound source information generated in the sound source information generation step S7.

The termination determination step S9 is a processing step that for executing a portion of the processing performed by the above-described user interface unit 9, and examines the presence or absence of a termination instruction from the user. In the event that a termination instruction exists, the termination determination step S9 controls the flow of processing to a termination step S12 (left branch), and if not, controls the flow of processing to a confirmation determination step S10 (right branch).

The confirmation determination step S10 is a processing step for executing a portion of the processing performed by the above-described user interface unit 9, and examines the presence or absence of a confirmation instruction from the user. In the event that a confirmation instruction exists, the confirmation determination step S10 controls the flow of processing to a information presentation/setting acceptance step S11 (left branch), and if not, controls the flow of processing to the acoustic signal input step S2 (upper branch).

The information presentation/setting acceptance step S1 is a processing step for executing, upon acceptance of a confirmation instruction from the user, a portion of the processing performed by the above-described user interface unit 9, and enables the user to verify operations of the acoustic signal processing and adjusting the same to ensure desired operations, and subsequently continue processing in an adjusted state by: presenting various setting contents necessary for the above described acoustic signal processing to a user; accepting settings and input from the user; saving setting contents to an external storage device according to a saving instruction and reading out setting contents from the same according to a reading-out instruction; visualizing and presenting the user with various processing results and intermediate results; and allowing the user to select desired data for visualization in greater detail.

The termination step S12 is a processing step for executing, upon acceptance of a termination instruction from the user, a portion of the processing performed by the above-described user interface unit 9, and automatically executes saving of various setting contents necessary for acoustic signal processing to an external storage device.

(Advantages)

The method according to Nakadai, Kazuhiro, et al., "Real-Time Active Human Tracking by Hierarchical Integration of Audition and Vision", The Japanese Society for Artificial Intelligence AI Challenge Study Group, SIG-Challenge-0113-5, 35-42, June 2001 described above performs estimation of a number, directions and components of sound sources by detecting a basic frequency component and harmonic components thereof, which configure a harmonic structure, from frequency-decomposed data. The assumption of a harmonic structure suggests that this method is specialized for human voices. However, since a real environment includes a large number of sound sources without harmonic structures, such as the opening and closing of a door, this method is incapable of addressing such source sounds.

In addition, although the method according to Asano, Futoshi, "Separating Sound", Journal of the Society of Instrument and Control Engineers, Vol. 43, No. 4, 325-330, April 2004 is not bound to any particular model, as long as two microphones are used, the method is only able to handle a single sound source.

According to the present embodiment, by grouping phase differences for respective frequency components obtained by sound sources using Hough transform, a function is realized which specifies and separates two or more sound sources using two microphones. In addition, sound source directions may be computed with greater accuracy.

What is claimed is:

1. An acoustic signal processing apparatus comprising:

an acoustic signal inputting unit configured to input a plurality of acoustic signals obtained by a plurality of microphones arranged at different positions;

a frequency decomposing unit configured to respectively decompose each acoustic signal into a plurality of frequency components, and for each frequency component, generate frequency decomposition information for which a signal level and a phase have been associated;

a phase difference computing unit configured to compute a phase difference between two predetermined pieces of the frequency decomposition information, for each corresponding frequency component;

a two-dimensional data converting unit configured to convert into two dimensional data made up of point groups arranged on a two-dimensional coordinate system having a frequency component as a first axis and a phase difference as a second axis;

a voting unit configured to perform Hough transform on the point groups, generate a plurality of loci respectively corresponding to each of the point groups in a Hough voting space, and when adding a voting value to a position in the Hough voting space through which the plurality of loci passes, perform addition by varying the voting value based on a level difference between first and second signal levels respectively indicated by the two pieces of frequency decomposition information; and a shape detecting unit configured to retrieve a position where the voting value becomes maximum to detect, from the two-dimensional data, a shape which corresponds to the retrieved position, which indicates a proportional relationship between the frequency component and the phase difference, and which is used to estimate a sound source direction of each of the acoustic signals.

2. The apparatus according to claim 1, wherein the shape detecting unit varies resolution used when detecting the shape that indicates a proportional relationship between the frequency component and the phase difference so that a resolution used when detecting an angle of the sound source direction is approximately the same across a range in which an angle of the sound source direction is detectable.

3. The apparatus according to claim 1, further comprising a shape collating unit configured to deem the two pieces of frequency decomposition information compared by the phase difference computing unit to be a single unit and use detected shape for each unit to generate a plurality of sound source candidate information regarding candidates of sound sources, and associate the plurality of generated sound source candidate information.

4. The apparatus according to claim 3, further comprising:

a sound source information generating unit configured to generate sound source information based on the plurality of associated sound source candidate information, and an outputting unit configured to output the sound source information.

5. An acoustic signal processing method comprising:

inputting a plurality of acoustic signals obtained by a plurality of microphones arranged at different positions;

decomposing each acoustic signal into a plurality of frequency components, and for each frequency component, generating frequency decomposition information for which a signal level and a phase have been associated, for each of the acoustic signals;

computing a phase difference between two predetermined pieces of the frequency decomposition information, for each corresponding frequency component;

converting into two dimensional data made up of point groups arranged on a two-dimensional coordinate system having a frequency component as a first axis and a phase difference as a second axis;

performing Hough transform on the point groups, generating a plurality of loci respectively corresponding to each of the point groups in a Hough voting space, and when adding a voting value to a position in the Hough voting space through which the plurality of loci passes, performing addition by varying the voting value based on a level difference between first and second signal levels respectively indicated by the two pieces of frequency decomposition information; and retrieving a position where the voting value becomes maximum to detect, from the two-dimensional data, a shape which corresponds to the retrieved position, which indicates a proportional relationship between the frequency component and the phase difference, and which is used to estimate a sound source direction of each of the acoustic signals.

6. The method according to claim 5, wherein the retrieving a position includes varying a resolution used when detecting the shape that indicates a proportional relationship between the frequency component and the phase difference so that a resolution used when detecting an angle of the sound source direction is approximately the same across a range in which an angle of the sound source direction is detectable.

7. The method according to claim 5, further comprising deeming the two pieces of frequency decomposition information to be compared to be a single unit and using detected shape for each unit to generate a plurality of sound source candidate information regarding candidates of sound sources, and associating the plurality of generated sound source candidate information.

8. The method according to claim 7, further comprising:

generating sound source information based on the plurality of associated sound source candidate information, and outputting the sound source information.

9. A non-transitory computer readable medium storing an acoustic signal processing program for causing a computer to execute instructions to perform steps of:

inputting a plurality of acoustic signals obtained by a plurality of microphones arranged at different positions;

decomposing each acoustic signal into a plurality of frequency components, and for each frequency component, generating frequency decomposition information for which a signal level and a phase have been associated, for each of the acoustic signals;

computing a phase difference between two predetermined pieces of the frequency decomposition information, for each corresponding frequency component;

converting into two dimensional data made up of point groups arranged on a two-dimensional coordinate system having a frequency component as a first axis and a phase difference as a second axis;

performing Hough transform on the point groups, generating a plurality of loci respectively corresponding to each of the point groups in a Hough voting space, and when adding a voting value to a position in the Hough voting space through which the plurality of loci passes, performing addition by varying the voting value based on a level difference between first and second signal levels respectively indicated by the two pieces of frequency decomposition information; and retrieving a position where the voting value becomes maximum to detect, from the two-dimensional data, a shape which corresponds to the retrieved position, which indicates a proportional relationship between the frequency component and the phase difference, and which is used to estimate a sound source direction of each of the acoustic signals.

10. The medium according to claim 9, wherein the retrieving a position includes varying a resolution used when detecting the shape that indicates a proportional relationship between the frequency component and the phase difference so that a resolution used when detecting an angle of the sound source direction is approximately the same across a range in which an angle of the sound source direction is detectable.

11. The medium according to claim 9, wherein the acoustic signal processing program further causes the computer to execute instructions to perform the step of deeming the two pieces of frequency decomposition information to be compared to be a single unit and using detected shape for each unit to generate a plurality of sound source candidate information regarding candidates of sound sources, and associating the plurality of generated sound source candidate information.

12. The medium according to claim 11, wherein the acoustic signal processing program further causes the computer to execute instructions to perform the steps of:

generating sound source information based on the plurality of associated sound source candidate information, and outputting the sound source information.

* * * * *